US007301520B2

(12) United States Patent
Koyama et al.

(10) Patent No.: US 7,301,520 B2
(45) Date of Patent: Nov. 27, 2007

(54) IMAGE DISPLAY DEVICE AND DRIVER CIRCUIT THEREFOR

(75) Inventors: Jun Koyama, Kanagawa-ken (JP); Munehiro Azami, Kanagawa-ken (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/777,693

(22) Filed: Feb. 7, 2001

(65) Prior Publication Data

US 2001/0048408 A1 Dec. 6, 2001

(30) Foreign Application Priority Data

Feb. 22, 2000 (JP) ..... 2000-043756

(51) Int. Cl.
*G09G 3/36* (2006.01)

(52) U.S. Cl. ..... 345/98; 345/87; 345/88; 345/89; 345/92; 345/96; 345/100; 345/103; 345/104

(58) Field of Classification Search ..... 345/98, 345/100, 103–104, 84, 87–90, 92, 96, 54–55, 345/64, 30; 257/40, 70, 103, 65–66, 59; 438/151, 486, 150, 535
See application file for complete search history.

(56) References Cited

U.S. PATENT DOCUMENTS 4,571,584 A * 2/1986 Suzuki ..... 345/94
5,162,786 A 11/1992 Fukuda
5,170,158 A * 12/1992 Shinya ..... 345/98
5,247,190 A * 9/1993 Friend et al. ..... 257/40
5,399,502 A 3/1995 Friend et al.
5,406,304 A * 4/1995 Shirayama ..... 345/98
5,420,604 A * 5/1995 Scheffer et al. ..... 345/100
5,489,918 A 2/1996 Mosier
5,589,847 A * 12/1996 Lewis ..... 345/98

(Continued)

FOREIGN PATENT DOCUMENTS

CN 1052565 6/1991

(Continued)

OTHER PUBLICATIONS

EuroDisplay '99, The 19th International Display Research Conference Proceedings, Sep. 6-9, 1999, Polymers for Light Emitting Diodes, pp. 33-37.

*Primary Examiner*—Richard Hjerpe
*Assistant Examiner*—Leonid Shapiro
(74) *Attorney, Agent, or Firm*—Nixon Peabody LLP; Jeffrey L. Costellia

(57) ABSTRACT

There is provided an image display device operating in response to the input of digital picture signals, in which the occupied area of a signal line driver circuit thereof is reduced, and the parasitic capacitance and resistance of input transmission lines of the digital picture signals are reduced. The device includes both a unit for directly inputting the digital picture signals to shift registers and for performing series parallel conversion, and a unit for causing n (n is a natural number not less than 2) signal lines to jointly own storage circuits and D/A converter circuits in the signal line driver circuit. One horizontal scan period is divided into n periods, and the storage circuits and the D/A converter circuits perform a processing to signal lines different in each of the divided periods.

36 Claims, 28 Drawing Sheets

U.S. PATENT DOCUMENTS

| | | | | |
|---|---|---|---|---|
| 5,642,117 | A * | 6/1997 | Luder et al. | 341/152 |
| 5,689,847 | A * | 11/1997 | Tremel et al. | 8/159 |
| 5,771,031 | A * | 6/1998 | Kinoshita et al. | 345/98 |
| 5,953,003 | A | 9/1999 | Kwon et al. | |
| 5,977,940 | A * | 11/1999 | Akiyama et al. | 345/94 |
| 6,049,321 | A * | 4/2000 | Sasaki | 345/99 |
| 6,097,362 | A | 8/2000 | Kim | |
| 6,118,798 | A * | 9/2000 | Ema et al. | 372/29.011 |
| 6,232,946 | B1 * | 5/2001 | Brownlow et al. | 345/98 |
| 6,256,079 | B1 * | 7/2001 | Matsushima | 349/106 |
| 6,281,891 | B1 * | 8/2001 | DaCosta et al. | 345/206 |
| 6,333,725 | B1 * | 12/2001 | Kim | 345/61 |
| 6,337,677 | B1 * | 1/2002 | Higashi | 345/100 |
| 6,380,917 | B2 * | 4/2002 | Matsueda et al. | 345/89 |
| 6,384,806 | B1 * | 5/2002 | Matsueda et al. | 345/89 |
| 6,462,728 | B1 * | 10/2002 | Janssen et al. | 345/100 |
| 6,496,169 | B1 * | 12/2002 | Mametsuka | 345/87 |
| 6,597,349 | B1 | 7/2003 | Koyama et al. | |
| 2006/0132420 | A1 * | 6/2006 | Yoshida et al. | 345/98 |

FOREIGN PATENT DOCUMENTS

| | | | |
|---|---|---|---|
| CN | 1169787 | | 1/1998 |
| CN | 1213813 | | 4/1999 |
| EP | 0 433 054 | A2 | 6/1991 |
| EP | 0 837 446 | A1 | 4/1998 |
| EP | 0 895 220 | A1 | 2/1999 |
| EP | 0 929 064 | A1 | 7/1999 |
| EP | 0 938 074 | A1 | 8/1999 |
| GB | 2 325 329 | A | 11/1998 |
| JP | 10-092576 | A | 4/1998 |
| WO | 90-13148 | | 11/1990 |
| WO | WO 97/20300 | | 6/1997 |

* cited by examiner

IMAGE DISPLAY DEVICE AND DRIVER CIRCUIT THEREFOR

BACKGROUND OF THE INVENTION

1. Field of the Invention

The present invention relates to an image display device to which a digital picture signal is inputted and a driver circuit therefore. More particularly, the present invention is directed to a driver circuit for an image display device in which an occupied area of the driver circuit is reduced, and further. the delay of a digital picture signal to be inputted and the waveform distortion thereof are reduced.

2. Description of the Related Art

In recent years, an image display device in which semiconductor thin films are formed on a glass substrate, in particular an active matrix image display device using thin film transistors (hereinafter referred to as TFTs) has come into wide use. The active matrix image display device (hereinafter referred to as image display device) using the TFTs includes hundreds of thousand to several million TFTs arranged in a matrix form, which control electric charges of respective pixels.

Further, as a recent technique, a polysilicon TFT technique for simultaneously forming a driver circuit by using TFTs at the outside of a pixel array portion. in addition to pixel TFTs constituting pixels, has been developed.

Besides, as the driver circuit, not only one for processing an analog picture signal but also one for processing a digital picture signal is realized.

FIG. 25 shows a structural example of an active matrix type liquid crystal display device as one of the image display device. As shown in FIG. 25. this liquid crystal display device is constituted by a signal line driver circuit 101. a scan line driver circuit 102, a pixel array portion 103, signal lines 104, scan lines 105, pixel TFTs 106. liquid crystals 107, and the like.

FIG. 26 is a view for explaining in detail a structure of a conventional (digital system) signal line driver circuit for processing a digital picture signal. FIG. 27 is a timing chart corresponding to FIG. 26. Here, an example of an image display device having k (horizontal)×l (vertical) pixels will be described. Although a case where a digital picture signal has three bits is exemplified for facilitating the explanation, the number of bits in an actual image display device is not limited to 3. Besides, FIGS. 26 and 27 shows a specific example of k=640.

The conventional signal line driver circuit has the following structure. This is constituted by a shift register to which a clock signal (CLK) and a start pulse are inputted and which sequentially shifts the pulse, first storage circuits (LAT 1) for sequentially storing digital picture signals by the output of the shift register, second storage circuits (LAT 2) for storing the outputs of the first storage circuits in accordance with input of a latch signal (LP), and D/A converter circuits (DAC) for converting the outputs of the second storage circuits into analog signals. Here, a latch circuit is used for the storage circuit.

The number of shift register stages (corresponding to the number of DFFs shown in FIG. 26) becomes k+1. Output signals of the shift register become control signals (SR-001 to SR-640) of the first storage circuits (LAT 1) directly or through buffers. The first storage circuits (LAT 1) store digital picture signals (D0 to D2) in accordance with the output timing of the control signals. Here, as the first storage circuits (LAT 1), 3 (number of bits)×k (number of horizontal signal lines) circuits become necessary. Also as the second storage circuits (LAT 2), 3×k circuits become necessary.

The clock signal (CLK) for the shift register, the start pulse (SP), the digital picture signals (D0 to D2), and the latch signal (LP) are inputted to the signal line driver circuit. First, the start pulse (SP) and the clock signal (CLK) are inputted to the shift register, and the pulse is sequentially shifted. Outputs (SR-001 to SR-640 in FIG. 26) of the shift register become, as shown in FIG. 27, pulses in which the clock signal (CLK) is shifted by the period. The first storage circuits (LAT 1) are operated by the output signals of the shift register, and store the digital picture signals inputted at that time. The pulse of the shift register is shifted for one line, so that the digital picture signals of the one line are stored in the first storage circuits (LAT 1). (L1-001 to L1-640 in FIG. 26, however, for simplification, they are collectively shown without discriminating the bits).

Next, the latch signal (LP) is inputted in a horizontal retrace period. By this latch signal, the second storage circuits (LAT 2) operate, and the picture signals (L1-001 to L1-640 in FIGS. 26 and 27) stored in the first storage circuits (LAT 1) are stored in the second storage circuits (LAT 2). When the horizontal retrace period is completed and a next horizontal scan period starts, the shift register again starts the operation. On the other hand, the digital picture signals (L2-001 to L2-640 in FIGS. 26 and 27, however, for simplification, they are collectively shown without discriminating the bits) stored in the second storage circuits (LAT 2) are converted into analog signals by the D/A converter circuits (DAC). The analog signals are transmitted to the signal lines (S001 to S640 in FIG. 26), and are further written into the corresponding pixels through the pixel TFTs which are switched on by the scan line driver circuit.

By the above operation, the image display device writes the picture signals into the pixels and carries out a display.

As compared with an analog system, the digital system driver circuit as described above has a defect that its occupied area is very large. Although the digital system has a merit that a signal can be expressed by two values of "Hi" and "Lo", the amount of data becomes large instead, and it becomes a serious obstacle from the viewpoint of miniaturization in constructing the image display device. The increase in area of the image display device has problems that the increase in its manufacturing costs is caused and the profit of a manufacturing company is made worse.

Besides, as the amount of information to be treated rapidly increases in recent years, an attempt to increase the number of pixels and to improve the definition of pixels has been made. However, as the number of pixels is increased, the driver circuit is also enlarged, and it is desired that the area of the driver circuit is further reduced.

Here, examples of generally used display resolution of a computer are set forth below with the number of pixels and standard name.

| number of pixels | standard name |
|---|---|
| 640 × 480 | VGA |
| 800 × 600 | SVGA |
| 1024 × 768 | XGA |
| 1280 × 1024 | SXGA |
| 1600 × 1200 | UXGA |

For example, in the case where the SXGA standard is cited as an example, when the number of bits is 8, 10240 first storage circuits, 10240 second storage circuits, and 10240

D/A converter circuits become necessary in the foregoing conventional driver circuit for 1280 signal lines. Besides, a high definition television receiver such as a high vision TV (HDTV) becomes popular, and a high definition image becomes necessary for not only the field of a computer but also the field of an Audio and Visual. In USA, ground wave digital broadcasting starts, and also in Japan, the age of digital broadcasting starts. In the digital broadcasting, the number of pixels of 1920×1080 is dominant, and prompt reduction in the area occupied by the driver circuit is demanded.

On the other hand, as shown in FIG. 26 as well, in the conventional digital system driver circuit, since it is necessary that signal transmission lines for supplying the digital picture signals (D0 to D2) are connected to all the first storage circuits (LAT 1), the extension of the wiring becomes very long. As a result, a load to the signal transmission line, such as load capacitance or resistance, becomes large, and the delay of the digital picture signal and the waveform distortion become large. This tendency becomes remarkable when the number of pixels increases, and there occurs a problem that a display based on accurate digital picture signals becomes difficult.

SUMMARY OF THE INVENTION

Then, for the purpose of solving the foregoing problems, the present invention has an object to provide a technique for reducing an occupied area of a signal line driver circuit and further to reduce the delay of a digital picture signal and the waveform distortion thereof.

Storage circuits and D/A converter circuits in a signal line driver circuit are jointly owned by n (n is a natural number not less than 2) signal lines, respectively. One horizontal scan period is divided into n periods, and the storage circuits and the D/A converter circuits perform a processing to the different signal lines in the divided respective periods, so that all the signal lines can be driven equally to the related art. In this way, it becomes possible to decrease the number of the storage circuits and that of the D/A converter circuits in the signal line driver circuit to 1/n of that of the related art. Incidentally, in the present specification, to perform a suitable processing to the signal line or the scan line for displaying an image is expressed by "to drive the signal line" or "to drive the scan line".

The digital picture signal is directly inputted to a shift register and is sequentially shifted in the shift register, and when it reaches a desired position, input of a clock signal is stopped to cease shifting the signal, and the signal is held at that position. A latch signal is inputted before the input of a next digital picture signal and a clock signal starts, so that the signal held in the shift register is transferred to the storage circuit, and whereby an operation equal to that up to the second storage circuit of the related art can be performed. Like this, by directly inputting the digital picture signal to the shift register, the signal transmission line for supplying the digital picture signal is shortened and the number of gates to be connected becomes several from several thousand, so that the gate capacitance becomes dramatically small, and it becomes possible to decrease the resistance and load capacitance of the signal transmission line.

DETAILED DESCRIPTION OF THE INVENTION

Here, an image display device in which the number of pixels in the horizontal direction and that in the vertical direction are made k and l, will be described as an example. In this mode of carrying the invention, although the description will be made on the assumption that a digital picture signal has 3 bits, the present invention is not limited to 3 bits, but is also effective for 6 bits, 8 bits, or the number of bits other than those. Besides, in the following description, although n is used as a parameter indicating how many signal lines are driven by one D/A converter circuit, when the number k of pixels in the horizontal direction is not a multiple of n, a multiple of n obtained by adding a suitable number to k is newly defined as k. In this case if the added pixel is treated as an imaginary one, any trouble does not occur in an actual operation.

Figure 1:
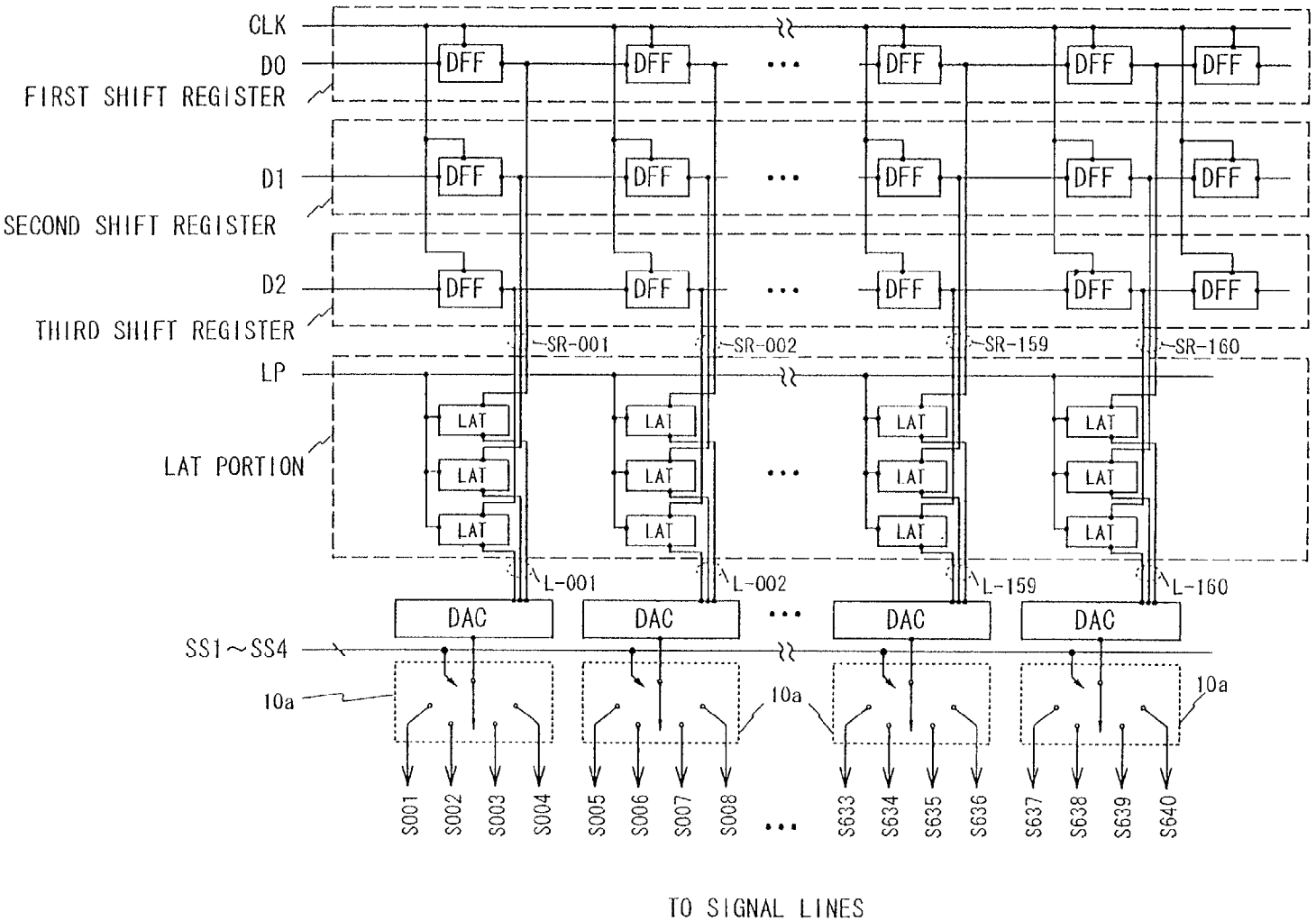
FIG. 1 is a view showing a structural example of a signal line driver circuit of a mode of carrying out the invention.
Figure 2:
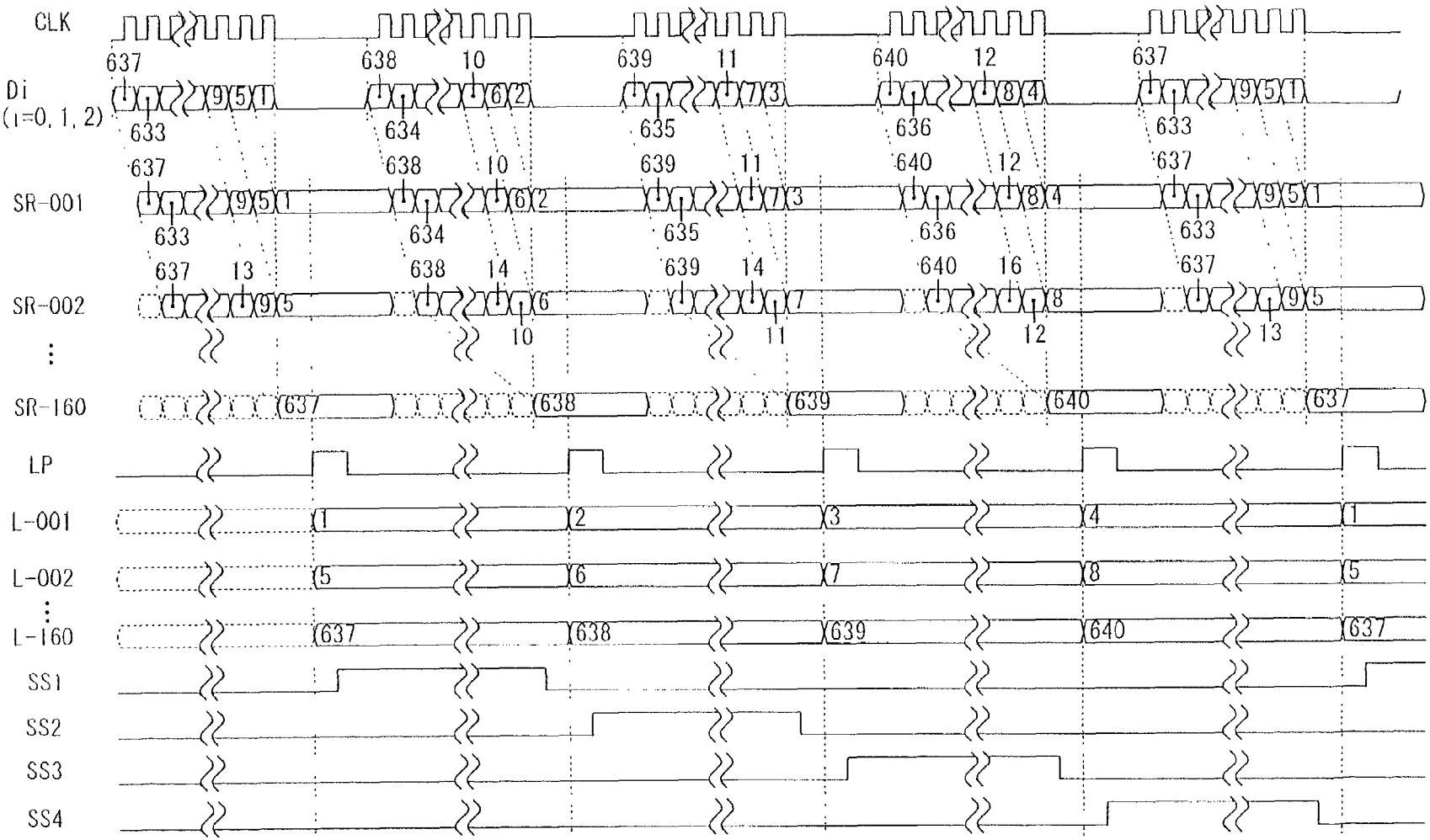
FIG. 2 is a view showing operation timing of the signal line driver circuit of FIG. 1.

Hereinafter, the structure of this mode will be described, and next, the operation of this mode will be described. FIG. 1 shows an example of a signal line driver circuit of this mode, and FIG. 2 shows its operation timing. FIGS. 1 and 2 show a specific example of k=640. Hereinafter, although characters such as k are used as a general explanation, a specific number corresponding to FIGS. 1 and 2 is indicated in brackets "[ ]". Incidentally, the structure of a scan line driver circuit and the structure of a pixel array portion are the same as the related art.

The signal line driver circuit of this mode includes three shift registers (first to third shift registers) comprised of delay type flip-flops (DFF), storage circuits (LAT), D/A converter circuits (DAC), and signal line selecting circuits 10*a*. In the related art, although a start pulse is inputted to the shift register, in this mode, a digital picture signal, not the start pulse, is inputted to the shift register. Besides, a latch signal (LP) is inputted to the respective storage circuits (LAT). Each of the D/A converter circuits (DAC) drives n signal lines, and the output of the D/A converter circuit is written into a suitable signal line by the signal line selecting circuit 10*a*. In FIGS. 1 and 2, a specific example of n=4 is shown.

As is understood from FIG. 1, there are 3×((k/n)+1) stage [i.e. 483 stage] DFFs, 3 k/n [i.e. 480] storage circuits (LAT), and k/n [i.e. 160] D/A converter circuits (DAC).

Next, the operation will be described with reference to FIG. 2. Digital picture signals (D0 to D2) of different bits and a clock signal (CLK) are inputted to the respective shift registers. The digital picture signals corresponding to all signal lines of one row are sequentially inputted in one horizontal scan period with the lapse of time. Thus, the signals D0, D1 and D2 are respectively constituted by digital picture signals corresponding to the respective signal lines. The arrangement order of the digital picture signals inputted in one horizontal scan period with the lapse of time is different from the related art, and when it is expressed by the numbers of the corresponding signal lines, it becomes ⌈(k−n+1, k−2n+1, . . . , n+1, 1), (k−n+2, k−2n+2, . . . , n+2, 2), (k−n+3, k−2n+3, . . . , n+3, 3),)k, . . . , (k, k−2n, . . . , 2n, n)⌋[i.e. (637, 633, . . . , 5, 1), (638, 634, . . . , 6, 2), (639, 635, . . . , 7, 3), (640, 636, . . . , 8, 4)]. Here, the parentheses "( )" express a subgroup. The respective shift registers sequentially shift the inputted digital picture signals in synchronization with the clock signal (CLK) [they are indicated by SR 001 to SR-160].

The latch signal (LP) is inputted n times to the storage circuits (LAT) in one horizontal scan period. In this embodiment, the latch signal is inputted at the following timing.

First, when the digital picture signal corresponding to the number k−n+1[i.e. 637] of the signal line in first subgroup is outputted from the (k/n)th stage [i.e. 160th stage] DFF, the clock signal is temporarily stopped, and the outputs from the respective DFFs are fixed. At this time. the first latch signal (LP) is inputted, and the outputs of the respective DFFs of the shift registers are stored in the respective storage circuits (LAT). In this operation, the digital picture signals corresponding to the numbers ⌈1, n+1, 2n+1, k−n+1⌋[i.e. ⌈1, 5, 9, . . . , 637⌋] of the signal lines are transferred to the storage circuits (LAT).

Thereafter, the digital picture signals of the second subgroup and the clock signal are inputted, and when the digital picture signal corresponding to the number k−n+2 [i.e. 638] of the signal line is outputted from the (k/n)th stage [i.e. 160th stage] DFF, the clock signal is temporarily stopped and the outputs from the respective DFFs are fixed. At this time, the second latch signal (LP) is inputted, and the outputs of the respective DFFs of the shift registers are stored in the respective storage circuits (LAT). By this operation, the digital picture signals corresponding to the numbers ⌈2, n+2, 2n+2, . . . , k−n+2⌋[i.e. ⌈2, 6, 10, . . . , 638⌋] of the signal lines are transferred to the storage circuits (LAT).

Hereinafter, the same operation is repeated, and when the digital picture signal corresponding to the number k [i.e. 640] of the signal line in the final nth subgroup is outputted from the (k/n)th stage [i.e. 160th stage] DFF, the clock signal is temporarily stopped and the outputs from the respective DFFs are fixed. At this time, the nth [i.e. fourth] latch signal (LP) is inputted, and the outputs of the respective DFFs of the shift registers are stored in the respective storage circuits (LAT). By this operation, the digital picture signals corresponding to the numbers ⌈n, 2n, 3n, . . . , k⌋[i.e, ⌈4, 8, 12, . . . , 640⌋] of the signal lines are transferred to the storage circuits (LAT).

By the input of the latch signals (LP) as described above, all the digital picture signals for one row of the signal lines are transferred to the storage circuits (LAT).

The outputs of the storage circuits (LAT) are inputted to the D/A converter circuits, and the 3-bit digital signals are converted into analog signals. The converted analog signals are written into the suitable signal lines through the signal line selecting circuits 10*a*. This writing timing will be described below.

As set forth above, the storage circuits also repeat the storage operation n times in one horizontal scan period. Thus, in the period when the digital picture signals corresponding to certain signal lines are stored in the storage circuits (LAT), the signal lines must be selected and writing must be completed.

First, in the period when the digital picture signals corresponding to the numbers ⌈1, n+1, 2n+1, . . . , k−n+1⌋[i.e. ⌈1, 5, 9, . . . , 637⌋] of the signal lines as the first subgroup are stored in the storage circuits (LAT), the first control signal (SS1) is inputted, and the respective signal line selecting circuits 10*a* select the signal lines of the numbers ⌈1, n+1, 2n+1, . . . , k−n+1⌋[i.e. ⌈1, 5, 9, . . . , 637⌋].

Next, the data in the storage circuits (LAT portion) is cleared, and in the period when the digital picture signals corresponding to the numbers ⌈2. n+2, 2n+2, . . . , k−n+2⌋ [i.e. ⌈2, 6, 10, . . . , 638⌋] of the signal lines as the second subgroup are stored in the storage circuits (LAT), the second control signal (SS2) is inputted, and the respective signal line selecting circuits 10*a* select the signal lines of the numbers ⌈2, n+2, 2n+2, . . . , k−n+2⌋[i.e. ⌈2, 6, 10, . . . , 638⌋].

In general, when i is a natural number, in the period when the digital picture signals corresponding to the numbers ⌈i, n+i, 2n+i, . . . , k−n+i⌋ of the signal lines as the ith subgroup are stored in the storage circuits (LAT), the ith control signal (SSi) is inputted, and the respective signal line selecting circuits 10*a* select the signal lines of the numbers ⌈i, n+i, 2n+i, . . . , k−n+i⌋.

In this way, the control signal pulse is inputted n times in one horizontal scan period to the signal line selecting circuits 10*a*, so that it becomes possible to write the outputs of the D/A converter circuits into the suitable signal lines.

Incidentally, a buffer circuit, a level shift circuit, an enable circuit for limiting an output period, or the like may be inserted between the output of the storage circuit (LAT) and the D/A converter circuit. Besides, the input arrangement order of the digital picture signals is not limited to the above order. This arrangement order is determined by an operation method of the signal line selecting circuits, an operation direction of the shift registers (input connection positions of the digital picture signals), or the like.

Figure 28:
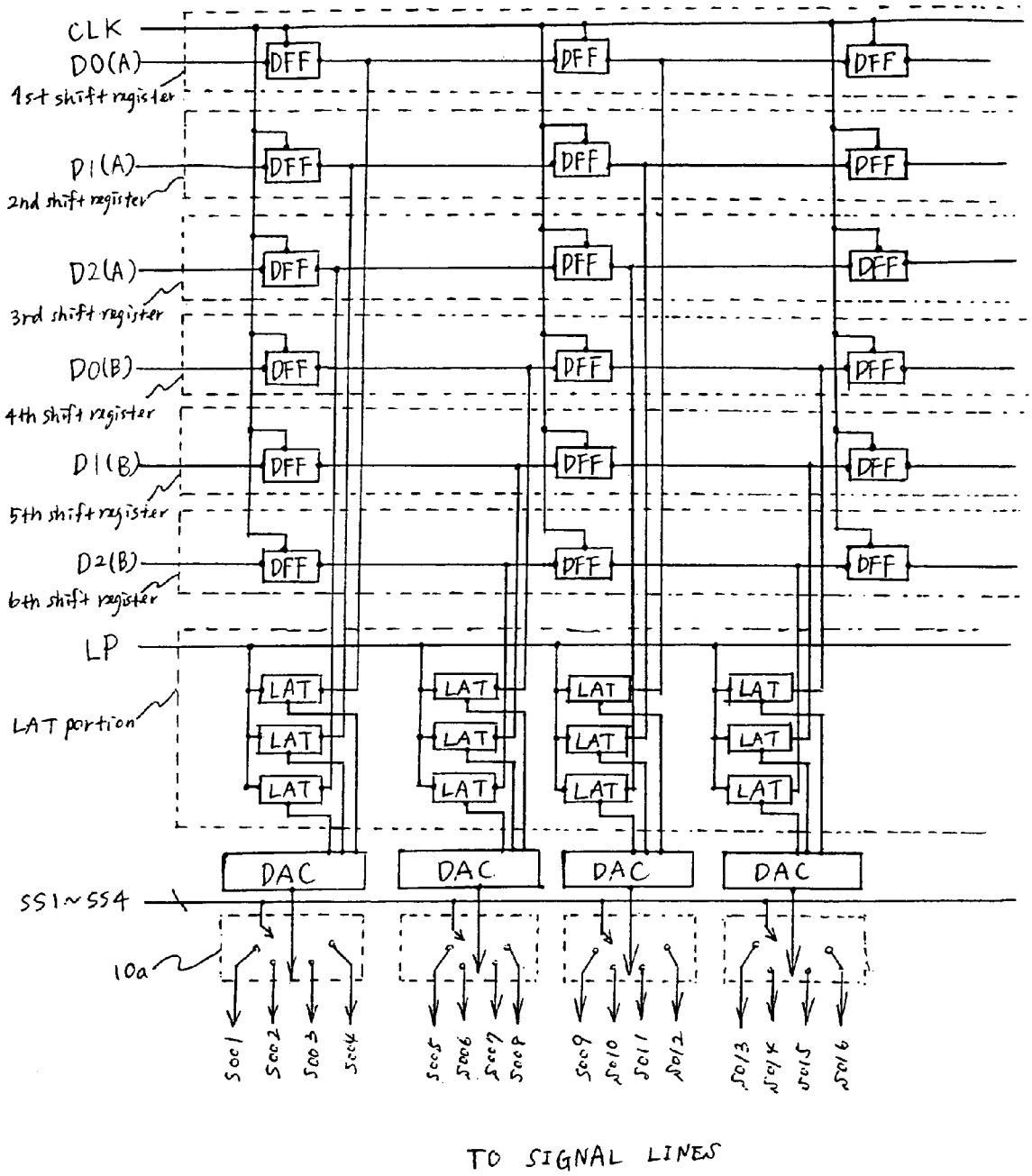
FIG. 28 is a view showing a structural example of a signal line driver circuit shown in FIG. 1 having a plurality of m shift registers, wherein the number of shift registers is a multiple of m.

Although this mode of the invention shows the case where the 3-bit digital picture signal is inputted without division, the digital picture signal to be inputted may be divided to a lower operation frequency of the shift register. In this case, signals for 3 bits×division number in total are input, and shift registers, the number of which is equal to the number of bits, become necessary. Incidentally, the number of DFFs contained in the respective shift registers is decreased correspondingly to the division number. An example of a number of shift registers being a multiple of m (i.e., 3) is shown in FIG. 28.

In the above mode of the invention, a ramp type D/A converter circuit may be used as the D/A converter circuit. In that case, the number of the D/A converter circuits is not limited to k/n.

Embodiment 1

In this embodiment, an image display device of the XGA standard in which the number of pixels in the horizontal direction is 1024 and the number of pixels in the vertical direction is 768, will be described. In this embodiment although the description will be made on the assumption that a digital picture signal has 3 bits, the present invention is not limited to 3 bits, but is also effective for 6 bits, 8 bits, or a bit number other than those. Besides, a case where one D/A converter circuit drives four signal lines will be exemplified.

Hereinafter, the structure of this embodiment will be described, and next, the operation of this embodiment will be described.

Figure 3:
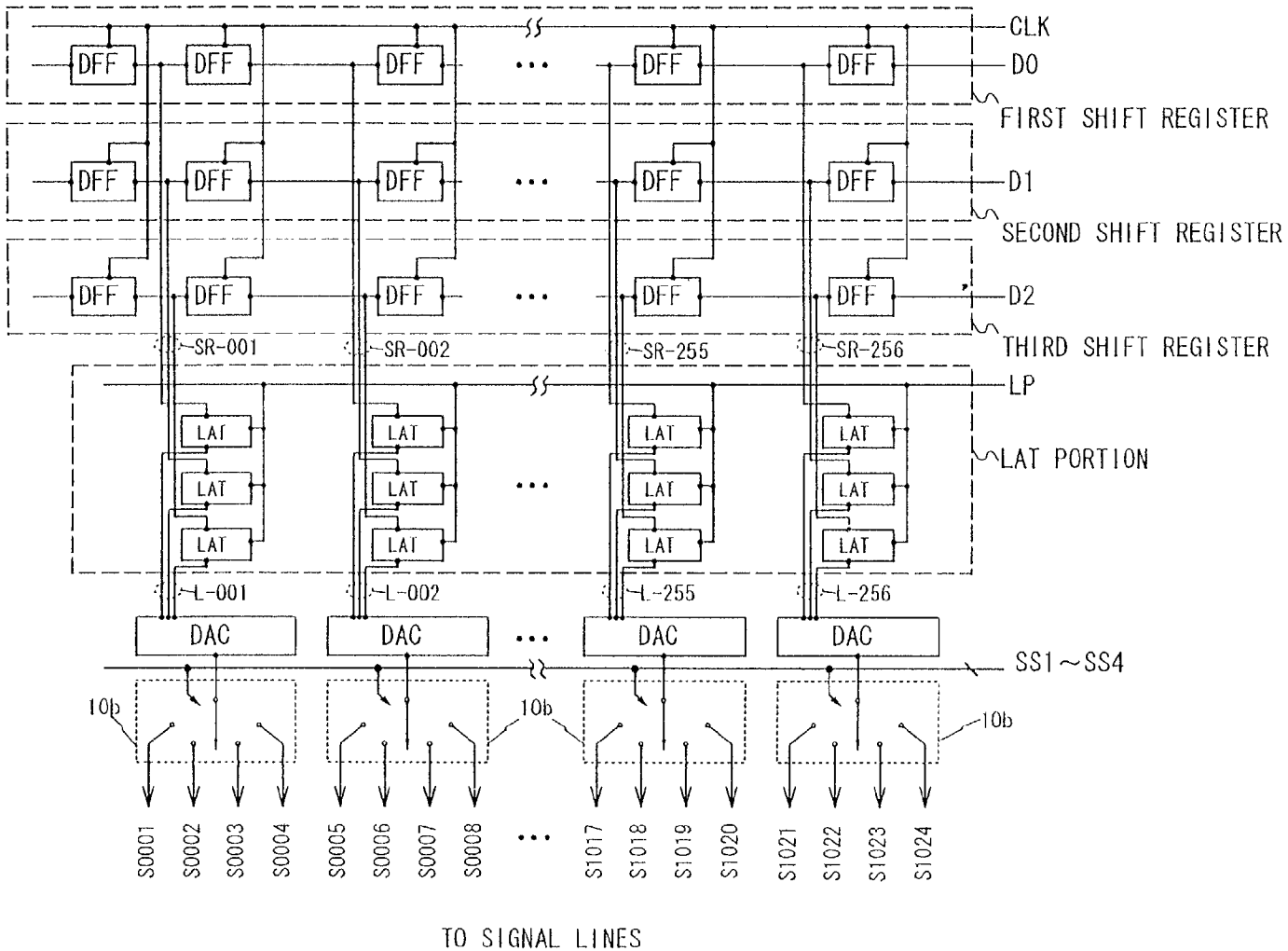
FIG. 3 is a view showing a structure of a signal line driver circuit of embodiment 1.

FIG. 3 shows a signal line driver circuit according to this embodiment. Since the structure of a scan line driver circuit and the structure of a pixel array portion are the same as the related art, their explanation is omitted. The signal line driver circuit of this embodiment includes three shift registers (first to third shift registers) each comprised of 257 stage DFFs. 256×3 (number of bits) storage circuits (LAT). 256 D/A converter circuits, and 256 signal line selecting circuits 10*b*.

Although a clock signal (CLK) is inputted to the respective shift registers in common, a digital picture signal (D0) of a first bit is inputted to the first shift register, a digital picture signal (D1) of a second bit is inputted to the second shift register. and a digital picture signal (D2) of a third bit is inputted to the third shift register. A latch signal (LP) is inputted to the storage circuits (LAT), and four control signals (SS1 to SS4) are inputted to the signal line selecting circuits 10*b*. Incidentally, in this embodiment, differently from the case of FIG. 1, signal transmission lines for supplying the digital picture signals are put on the right side of the signal line driver circuit.

Figure 4:
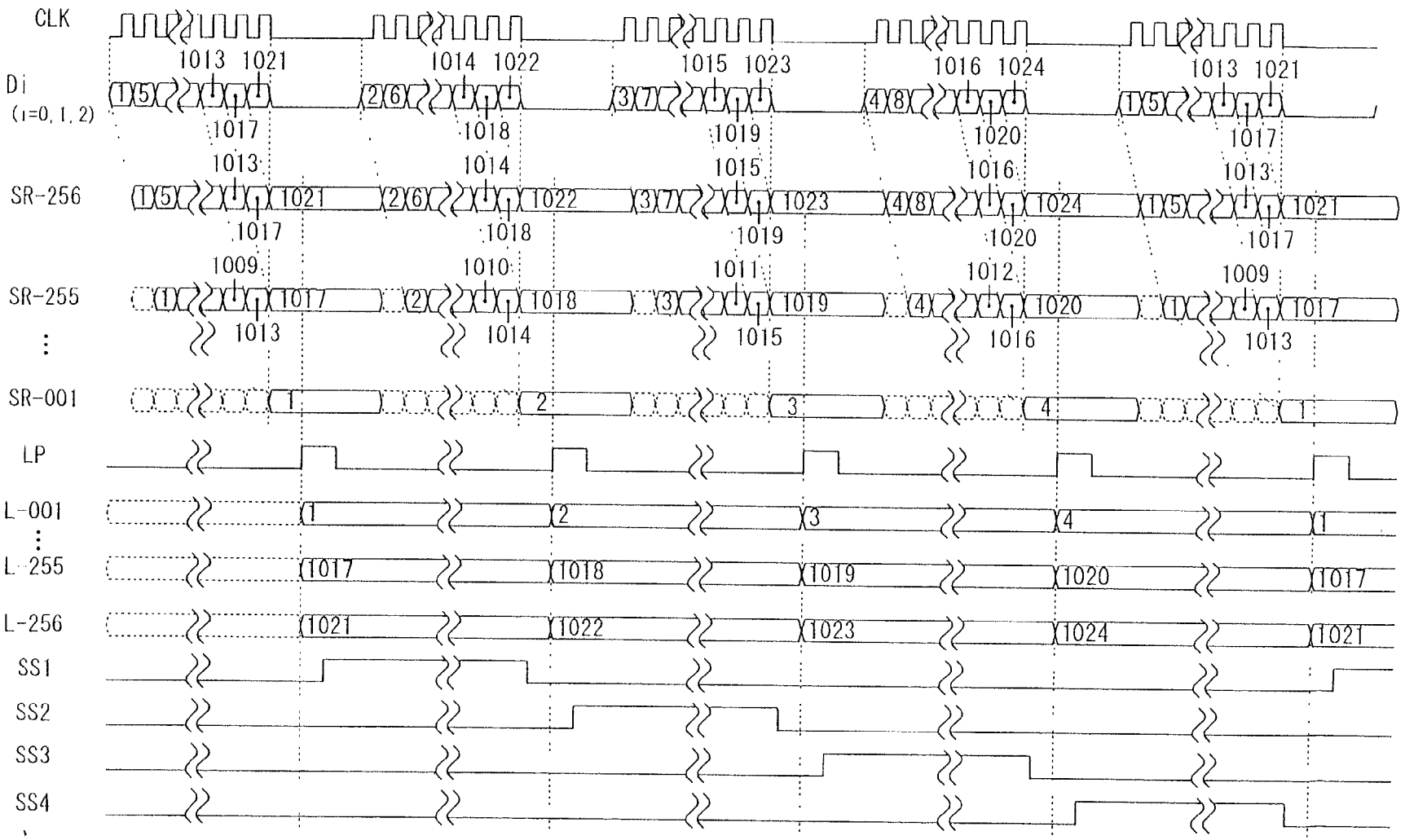
FIG. 4 is a view showing operation timing of the signal line driver circuit of FIG. 3.

Next, the operation will be described with reference to FIG. 4. The corresponding digital picture signals (Di (i=0 to 2)) and the clock signal (CLK) are inputted to the respective shift registers. The respective shift registers sequentially shift the inputted digital picture signals (Di) from the right to the left. This state is indicated by SR-256, SR-255, . . . , SR-001 in FIG. 4. When the arrangement order of the digital picture signals inputted with the lapse of time is expressed by the numbers of the corresponding signal lines, it becomes ⌈(1, 5, . . . , 1017, 1021), (2, 6, . . . , 1018, 1022), (3, 5, . . . , 1019, 1023), (4, 8, . . . , 1020, 1024)]. Here, the brackets "( )" express a subgroup. In this embodiment, differently from FIG. 1, since the digital picture signals are shifted from the right to the left, the arrangement order of the picture signals is also different from that shown in FIG. 2, and it becomes ascending order in the subgroup.

The latch signal (LP) to be inputted to the storage circuit (LAT) portion is inputted four times in one horizontal scan period. In this embodiment. the latch signal is inputted at the following timing.

First, in the first subgroup, when the digital picture signal corresponding to the number ⌈1⌋ of the signal line is outputted from the first stage DFF (in FIG. 3, the leftmost DFF is made a zero-th stage one), the clock signal is temporarily stopped, and the outputs from the respective DFFs are fixed. At this time, the first latch signal (LP) is inputted, and the outputs of the respective DFFs of the shift registers are stored in the respective storage circuits (LAT). By this operation. the digital picture signals corresponding to the numbers ⌈1, 5, . . . , 1017, 1021⌋ of the signal lines are transferred to the storage circuits (LAT), and at the same time, those signals are outputted to the D/A converter circuits.

Thereafter, the digital picture signals of the second subgroup and the clock signal are inputted, and when the digital picture signal corresponding to the number ⌈2⌋ of the signal line is outputted from the first stage DFF, the clock signal is temporarily stopped and the outputs from the respective DFFs are fixed. At this time, the second latch signal (LP) is inputted, and the outputs of the respective DFFs of the shift registers are stored in the respective storage circuits (LAT). By this operation the digital picture signals corresponding to the numbers ⌈2, 6, . . . , 1018, 1022⌋ of the signal lines are transferred to the storage circuits (LAT), and at the same time, those signals are outputted to the D/A converter circuits.

Next, the digital picture signals of the third subgroup and the clock signal are inputted, and when the digital picture signal corresponding to the number ⌈3⌋ of the signal line is outputted from the first stage DFF, the clock signal is temporarily stopped and the outputs from the respective DFFs are fixed. At this time, the third latch signal (LP) is inputted, and the outputs of the respective DFFs of the shift registers are stored in the respective storage circuits (LAT). By this operation, the digital picture signals corresponding to the numbers ⌈3, 7, . . . , 1019, 1023⌋ of the signal lines are transferred to the storage circuits (LAT), and at the same time, those signals are outputted to the D/A converter circuits.

Finally, the digital picture signals of the fourth subgroup and the clock signals are inputted, and when the digital picture signal corresponding to the number ⌈4⌋ of the signal line is outputted from the first stage DFF, the clock signal is temporarily stopped and the outputs from the respective DFFs are fixed. At this time, the fourth latch signal (LP) is inputted, and the outputs of the respective DFFs of the shift registers are stored in the respective storage circuits (LAT). By this operation, the digital picture signals corresponding to the numbers ⌈4, 8, . . . , 1020, 102⌋ of the signal lines are transferred to the storage circuits (LAT), and at the same time, those signals are outputted to the D/A converter circuits.

By the input of the latch signals as described above, all the digital picture signals for one row of the signal lines are transferred to the storage circuits (LAT).

The 3-bit digital signals inputted to the D/A converter circuits are converted into analog signals. The converted analog signals are written into the suitable signal lines through the signal line selecting circuits 10*b*. Hereinafter. this writing timing will be described.

The storage circuits (LAT) repeat the storing operation four times in one horizontal scan period. Thus, in the period when the digital picture signals corresponding to certain signal lines are stored in the storage circuits (LAT). the corresponding signal lines must be selected and writing must be completed.

First, in the period when the digital picture signals corresponding to the numbers ⌈1, 5, . . . , 1017, 1021⌋ of the signal lines as the first subgroup are stored in the storage circuits (LAT), the first control signal (SS1) is inputted. and the respective signal line selecting circuits 10*b* select the signal lines of the numbers ⌈1, 5, •••, 1017, 1021 ⌋.

Next, in the period when the digital picture signals corresponding to the numbers ⌈2, 6, . . . , 1018, 1022⌋ of the signal lines as the second subgroup are stored in the storage circuits (LAT), the second control signal (SS2) is inputted, and the respective signal line selecting circuits 10*b* select the signal lines of the numbers ⌈2, 6, . . . , 1018, 1022⌋.

Further, in the period when the digital picture signals corresponding to the numbers ⌈3, 7, . . . , 1019, 1023⌋ of the signal lines as the third subgroup are stored in the storage circuits (LAT), the third control signal (SS3) is inputted. and the respective signal line selecting circuits 10*b* select the signal lines of the numbers ⌈3, 7, . . . , 1019, 1023⌋.

Finally, in the period when the digital picture signals corresponding to the numbers ⌈4, 8, . . . , 1020, 1024⌋ of the signal lines as the fourth subgroup are stored in the storage circuits (LAT), the fourth control signal (SS4) is inputted, and the respective signal line selecting circuits 10*b* select the signal lines of the numbers ⌈4, 8, . . . , 1020, 1024⌋.

In this way, by inputting the control pulse four times to the signal line selecting circuits 10*b* in one horizontal scan period, it becomes possible to write the outputs of the D/A converter circuits into the suitable signal lines.

Incidentally, a buffer circuit, a level shift circuit, an enable circuit for limiting an output period, or the like may be inserted between the output of the storage circuit (LAT) and the D/A converter circuit. Besides, the input arrangement order of the digital picture signals is not limited to the above order. This arrangement order is determined by an operation method of the signal line selecting circuits, an operation direction of the shift registers (input connection positions of the digital picture signals), or the like. For example, it is already mentioned that the arrangement order of the signals in the subgroup is reversed according to whether the digital picture signals are inputted to the right of the signal line driver circuit or the left thereof. Besides, in the above, in the case where the timing when the pulse of the first control signal (SS1) of the signal line selecting circuits 10*b* is inputted is exchanged for the timing when the pulse of the fourth control signal (SS4) is inputted, the input arrangement order of the digital picture signals is also changed such that the first subgroup is exchanged for the fourth subgroup.

Figure 5A:
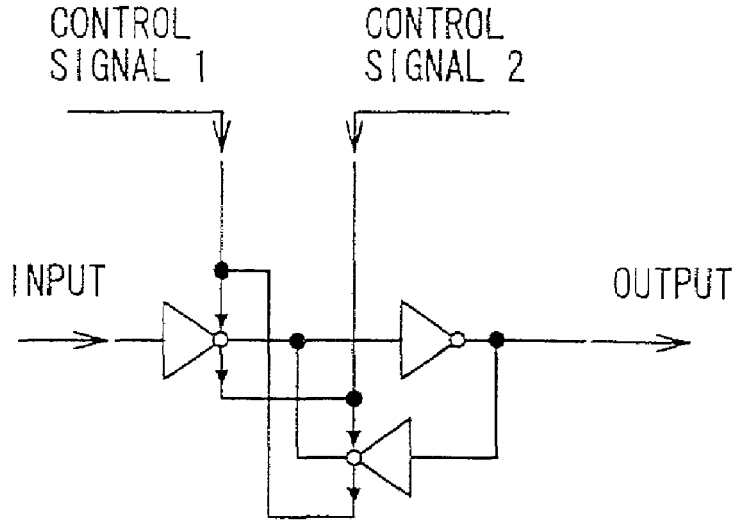
FIGS. 5A to 5C are views showing examples of latch circuits.
Figure 5B:
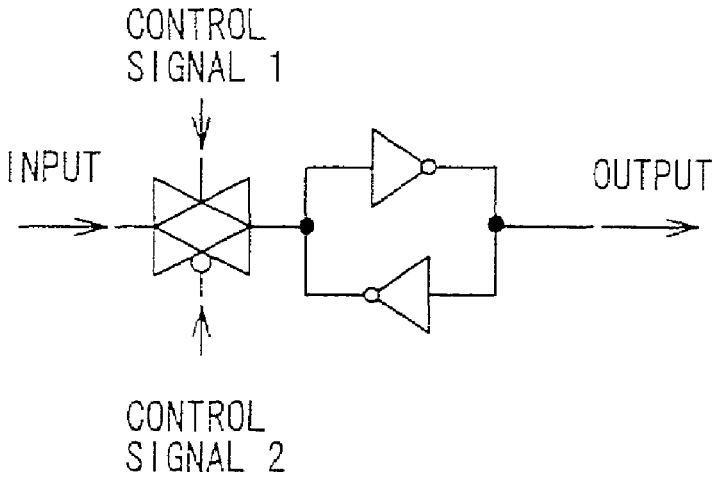
Figure 5C:
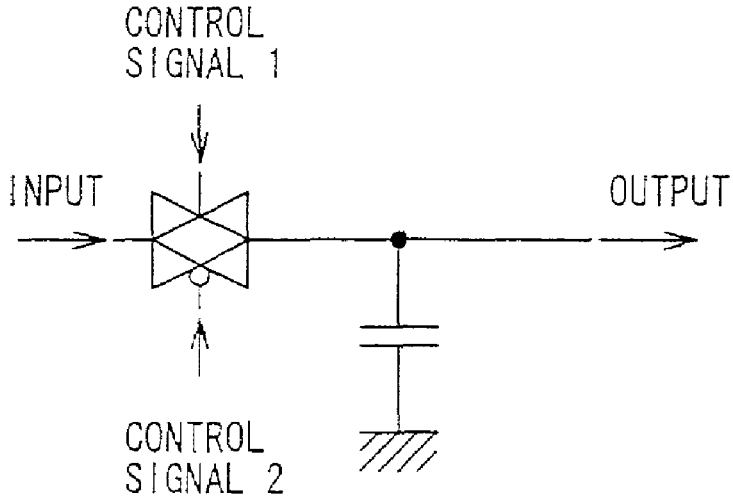

Specific examples of the storage circuit are shown in FIGS. 5A to 5C. FIG. 5A shows one using a clocked inverter, FIG. 5B shows an SRAM type one, and FIG. 5C shows a DRAM type one. These are typical examples, and the present invention is not limited to these types.

As described above, in the present invention, although the number of the shift registers is increased, it is possible to drive the image display device by the shift registers each made of circuits, the number of which is ¼ of the related art, the storage circuits, the number of which is ⅛ of the related art, and the D/A converter circuits, the number of which is ¼ of the related art, and it becomes possible to greatly reduce the occupied area of the driver circuit and the number of elements. Besides, since the digital picture signal is directly inputted to the shift register. it becomes possible to shorten the signal transmission line for supplying the digital picture signal, to make connected gate capacitance dramatically small, and to decrease the resistance and load capacitance of the signal transmission line.

Embodiment 2

Figure 6:
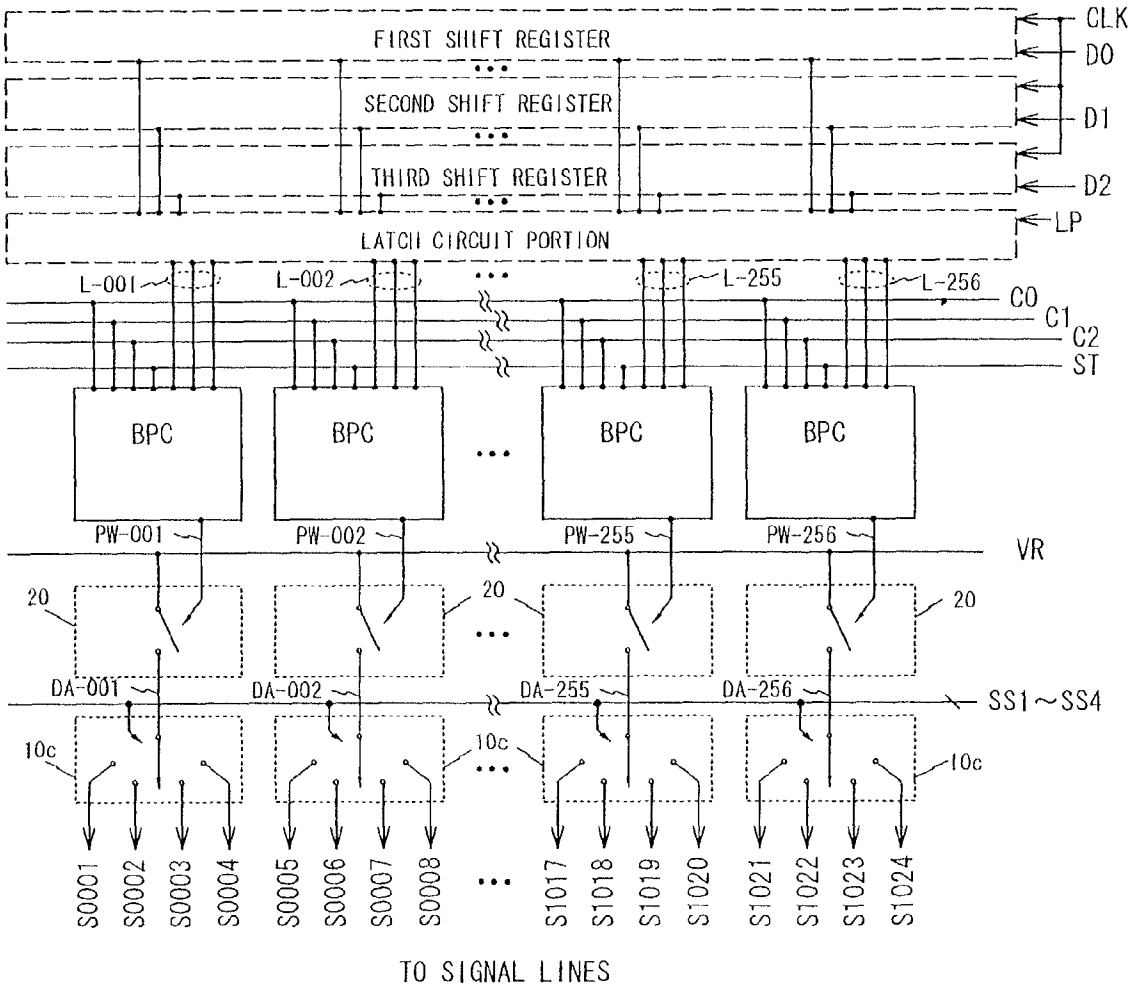
FIG. 6 is a view showing a structure of a signal line driver circuit of embodiment 2.

In this embodiment, an example of a case where a ramp system D/A converter circuit is adopted for a D/A converter circuit, will be described. FIG. 6 is a schematic view of a signal line driver circuit in the case where the ramp system D/A converter circuit is used. Incidentally, also in this embodiment, although the description will be made on a case corresponding to the image display device of the XGA standard and a 3-bit digital picture signal, the present invention is not limited to the 3 bits, but is also effective for a case corresponding to another bit number or the image display device of a standard other than the XGA.

The structure and operation of the embodiment will hereinafter be described.

In this embodiment, the structure from shift registers to storage circuits (LAT) is the same as the embodiment 1. At the downstream of the storage circuits. there are provided bit comparison pulse width converter circuits (BPC), analog switches 20. and signal line selecting circuits 10*c*. The 3-bit digital picture signals stored in the storage circuits (LAT), count signals (C0 to C2), and a set signal (ST) are inputted to the bit comparison pulse width converter circuits (BPC). Outputs (PW–i, i is 001 to 256) of the bit comparison pulse width converter circuits and a gradation power supply (VR) are inputted to the analog switches 20. Outputs of the analog switches 20 and control signals (SS1 to SS4) are inputted to the signal line selecting circuits 10*c*.

Figure 8:
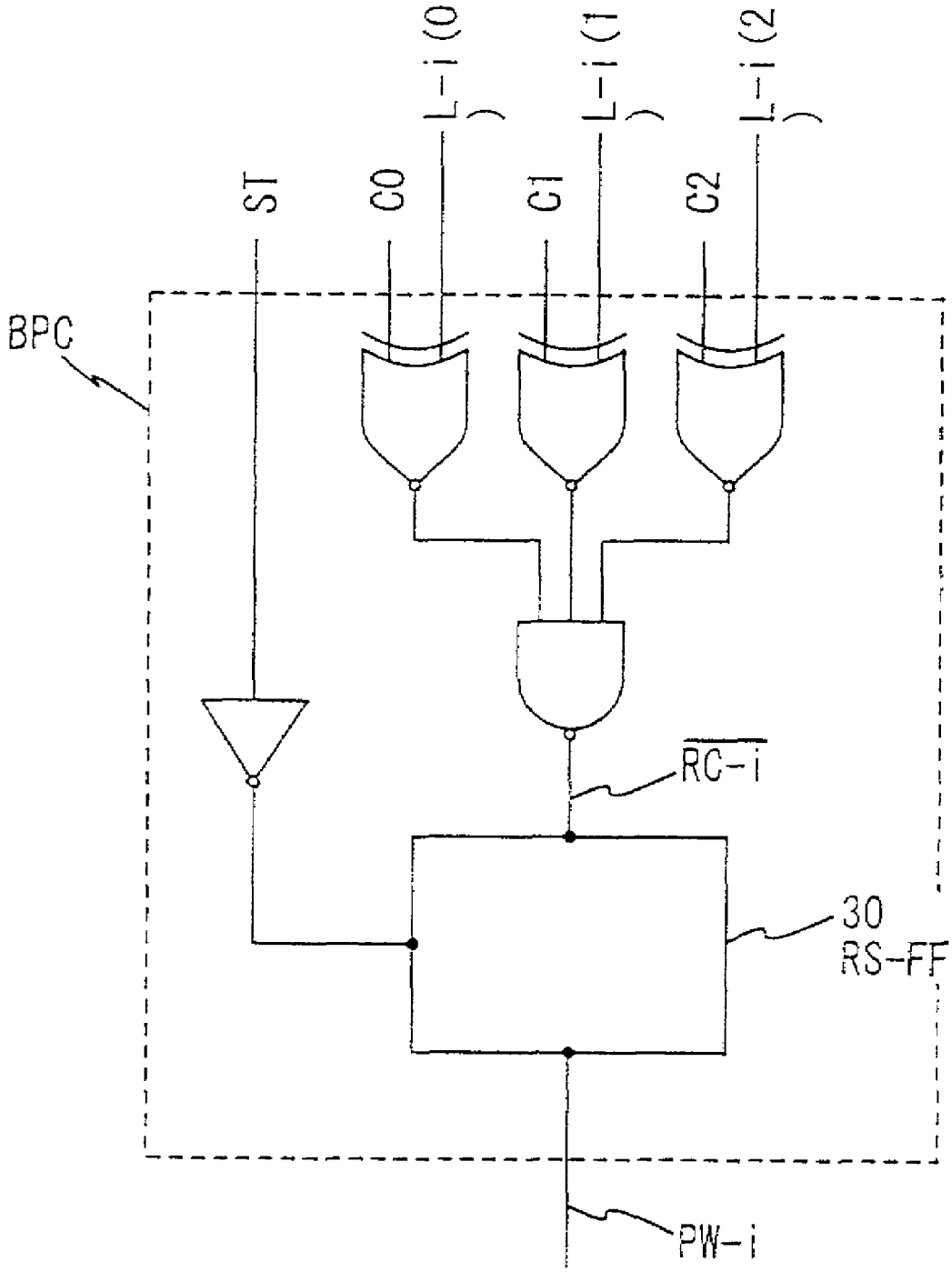
FIG. 8 is a view showing a structure of a bit comparison pulse width converter circuit (BPC)

A structural example of the bit comparison pulse width converter circuit (BPC) of an ith stage from the left in FIG. 6 is shown in FIG. 8. The BPC includes a 3-input NAND gate, an inverter, and a set reset flip-flop (RS-FF). In FIG. 8. the outputs of the ith stage storage circuit (LAT) are expressed by L-i(0). L-i(1), and L-i(2) for discriminating bits.

Figure 7:
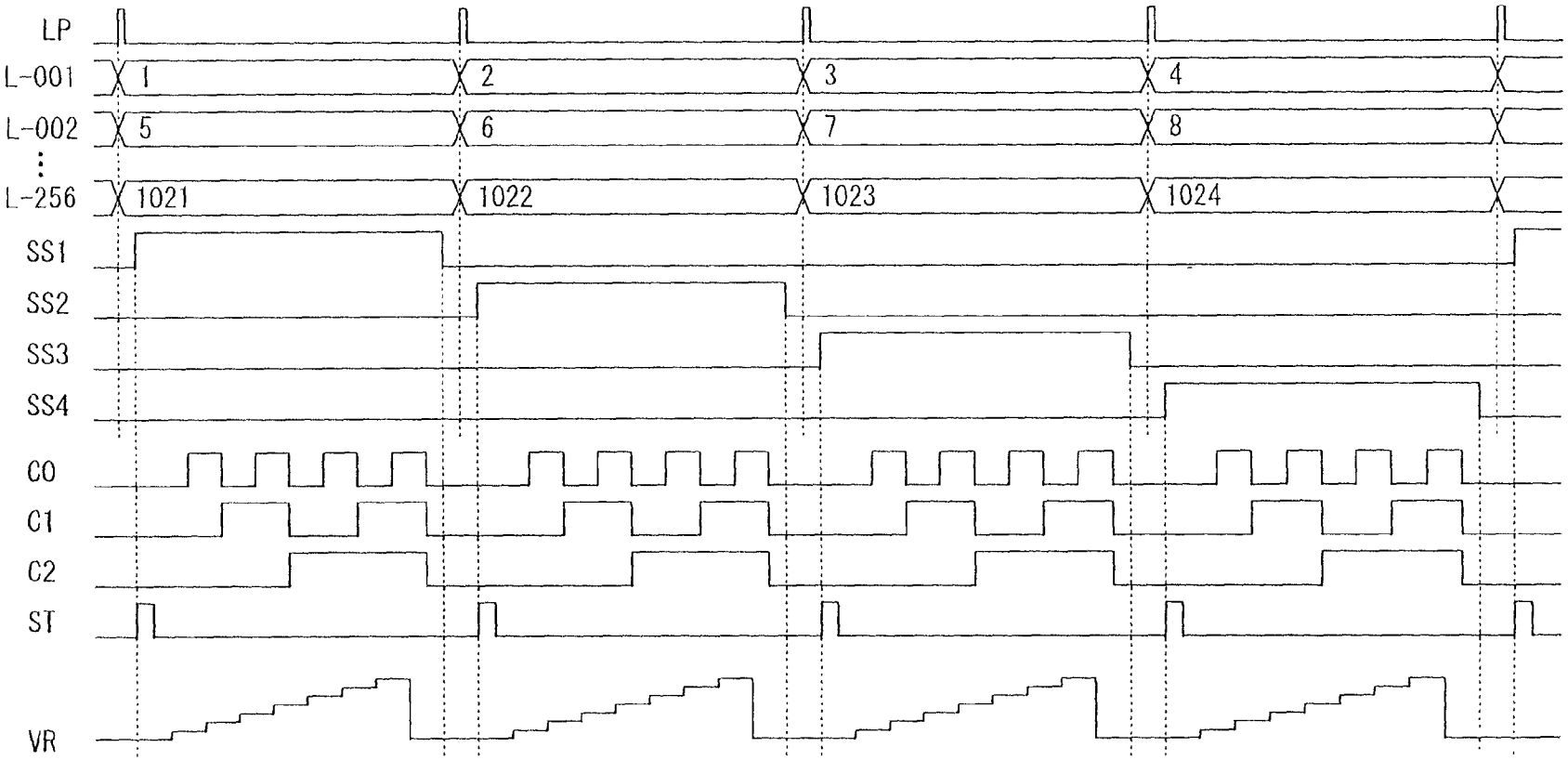
FIG. 7 is a view showing operation timing of the driver circuit of FIG. 6.

Next, the operation of this embodiment will be described. FIG. 7 shows the operation timing of a signal system necessary for understanding the circuit operation of FIG. 6. The operation from the shift registers to the storage circuits (LAT) is the same as the embodiment 1. Besides, the control signals (SS1 to SS4) inputted to the signal line selecting circuits 10*c* are also the same as the embodiment 1. Every time when four signal lines are sequentially selected by the signal line selecting circuit 10*c*, the count signals (C0 to C2), the set signal (ST) and the gradation power supply (VR) are periodically inputted. By this, writing of information into all the signal lines can be equally carried out.

Figure 9:
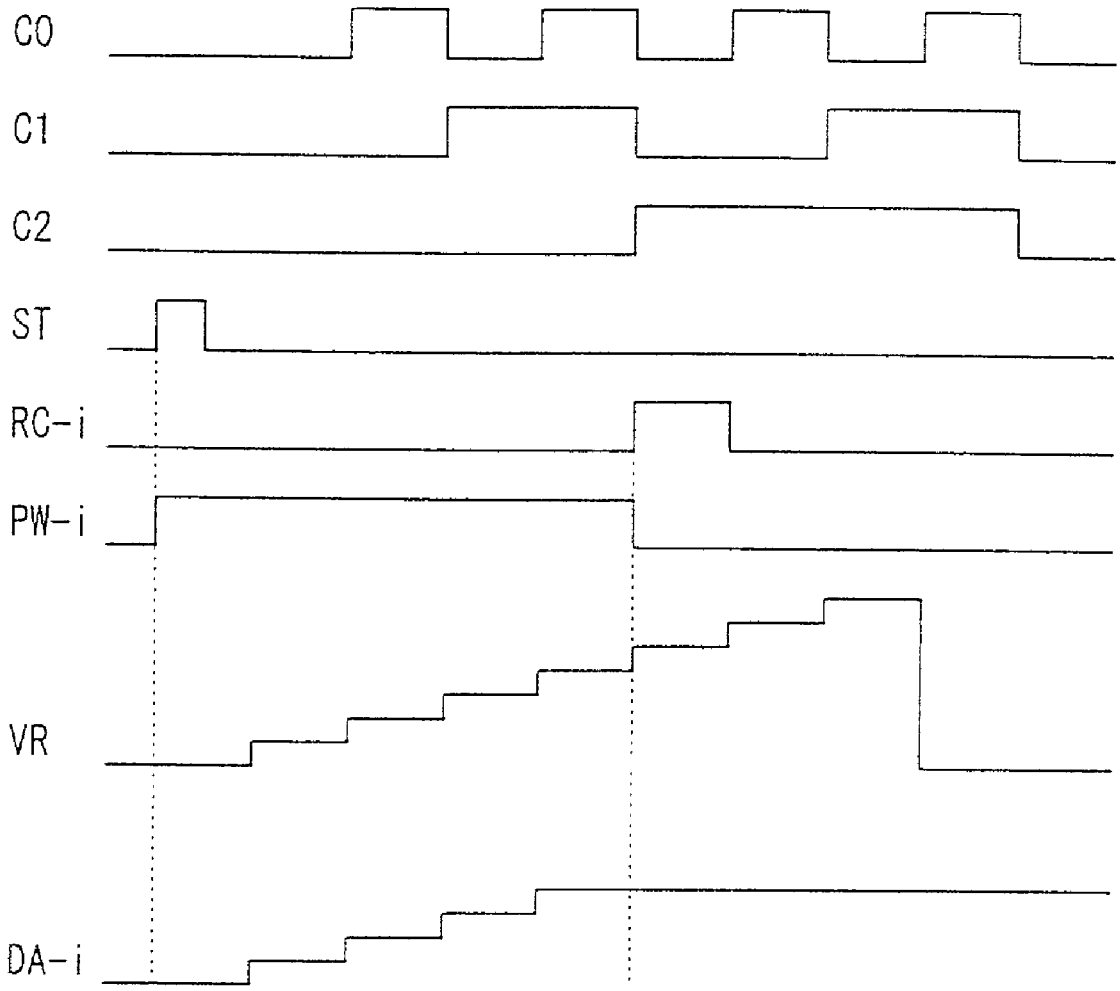
FIG. 9 is a view for explaining an operation of a ramp system D/A converter circuit.

In order to explain the operation of the ramp system D/A converter circuit in detail, FIG. 9 shows the operation timing of a period when one of the four signal lines is selected by the signal line selecting circuit. First, the RS-FF30 is set by the input of a set signal, and the output PW-i comes to have a Hi level. Next, the digital picture signal stored in the second latch circuit is compared with the count signals (C0 to C2) for every bit by exclusive-OR gates. In the case where all of the three bits are coincident, the outputs of all the exclusive-OR gates come to have the Hi level, and as a result, the output (inversion RC-i) of the 3-input NAND gate comes to have the Lo level (thus, RC-i comes to have the Hi level). The output of this 3-input NAND is also inputted to the RS-FF30, and when RC-i comes to have the Hi level, it is reset, and the output PW-i returns to the Lo level. FIG. 9 shows an output example of RC-i, PW-i, and DA-i in the case where the 3-bit digital picture signal {L-i(0), L-i(1), L-i(2)}is {0, 0, 1}. In this way, the information of the digital picture signal is converted into the pulse width of the output PW-i of the bit comparison pulse width converter circuit (BPC).

The output PW-i of the bit comparison pulse width converter circuit (BPC) controls switching of the analog switch 20. The gradation power supply (VR) having a step-like voltage level synchronizing with the count signals (C0 to C2) is applied to the analog switch 20. The switch is electrically connected to the signal line only in the period when the output PW-i of the BPC is in the Hi level, and writes the voltage at the instant when the PW-i comes to have the Lo level into the signal line.

By the above operation, the digital picture signal is converted into the analog signal, and the arbitrary potential is written into the signal line. Incidentally, it is not necessary that the gradation power supply (VR) is step-shaped, but a continuously monotonously changed one may be adopted. Besides, a buffer circuit, a level shift circuit or the like may be inserted between the output of the bit comparison pulse width converter circuit (BPC) and the analog switch 20.

As described above, in the present invention, the ramp system D/A converter circuit can also be used as the D/A converter circuit, and about ¼ of the related art is sufficient for the circuit structure, so that it becomes possible to greatly reduce the occupied area of the driver circuit and the number of elements.

Embodiment 3

In this embodiment, a description will be made on an example of a color image display device which is a single plate of the VGA standard in which the number of pixels in the horizontal direction is 640×3 (three colors of RGB) and the number of pixels in the vertical direction is 480, and can produce a color display. R, G and B indicate red, green and blue of the three primary colors of light, respectively. Also in this embodiment, although the description is made on the assumption that a digital picture signal has three bits, the present invention is not limited to 3 bits, but is also effective for 6 bits, 8 bits or a bit number other than those. Besides, a case where one D/A converter circuit drives three signal lines is cited as an example.

The structure and operation of the embodiment will hereinafter be described.

Figure 10:
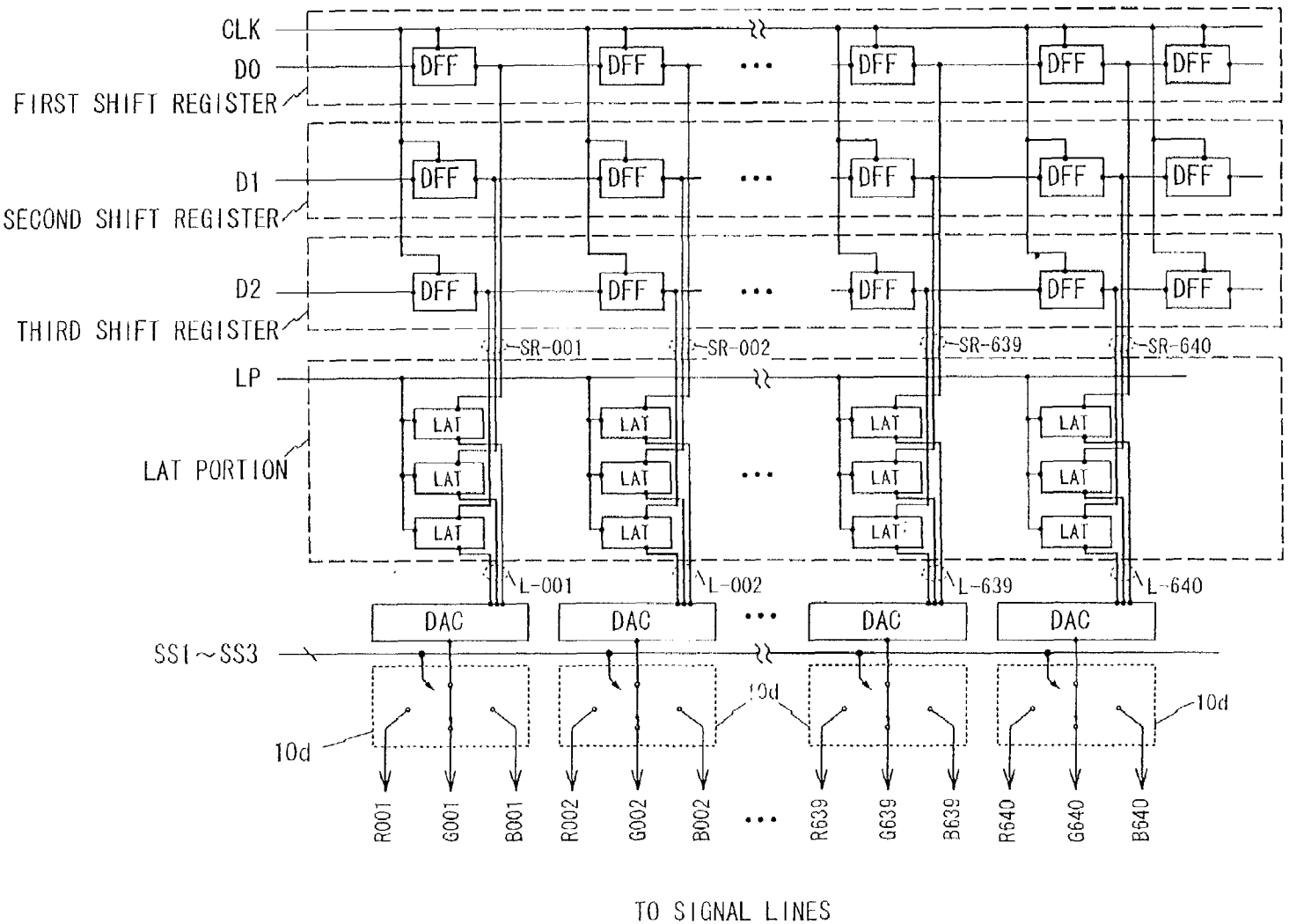
FIG. 10 is a view showing a structure of a signal line driver circuit of embodiment 3.

FIG. 10 shows a signal line driver circuit according to this embodiment. Since the structure of a scan line driver circuit and the structure of a pixel array portion are the same as the related art, their explanation is omitted. The signal line driver circuit of this embodiment includes three shift registers (first to third shift registers) each comprised of 641 stage DFFs, 640×3 (number of bits) storage circuits (LAT). 640 D/A converter circuits, and 640 signal line selecting circuits 10*d*.

Although a clock signal (CLK) is inputted to the respective shift registers in common, a first bit digital picture signal (D0) of RGB is inputted to the first shift register, a second bit digital picture signal (D1) of RGB is inputted to the second shift register, and a third bit digital picture signal (D2) of RGB is inputted to the third shift register. A latch signal (LP) is inputted to the storage circuits (LAT), and three control signals (SS1 to SS3) are inputted to the signal line selecting circuits 10*d*. Incidentally, in this embodiment, similarly to the case of FIG. 1, signal transmission lines for supplying the digital picture signals are coupled from the left side of the signal line driver circuit.

Figure 11:
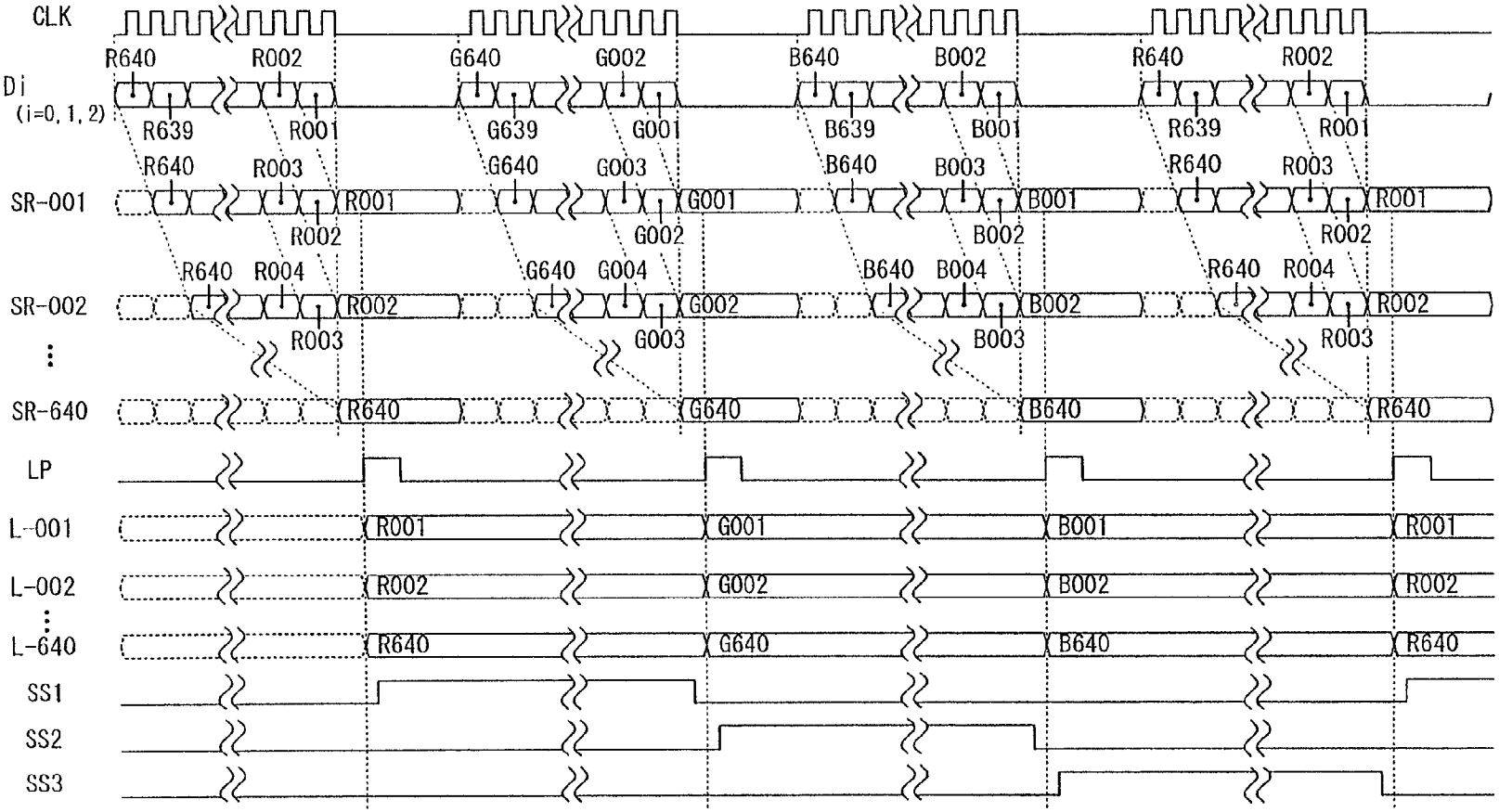
FIG. 11 is a view showing operation timing of the driver circuit of FIG. 10.

Next, the operation will be described with reference to FIG. 11. The corresponding RGB digital picture signals (Di (i=0 to 2)) and the clock signal (CLK) are inputted to the respective shift registers. The respective shift registers sequentially shift the inputted digital picture signals (Di) from the left to the right. This state is shown by SR-001, SR-002, . . . , SR-600 in FIG. 11. When the arrangement order of the digital picture signals to be inputted with the lapse of time is expressed by the designations of the corresponding signal lines shown in FIG. 10, it becomes ⌈(R640, R639, . . . , R002, R001), (G640, G639, . . . , G002, G001), (B640, B639, . . . , B002, B001)⌋. Here, the parentheses "( )" express a subgroup and they are collected for every RGB. In this embodiment, similarly to FIG. 1, since the digital picture signals are shifted from the left to the right, the arrangement order of the picture signals also becomes descending order in the subgroup similarly to FIG. 2.

The latch signal is inputted three times to the storage circuit (LAT) portion in one horizontal scan period. In this embodiment, the latch signal is inputted at the following timing.

First, in the first subgroup of "R", when the digital picture signal corresponding to the signal line ⌈R640⌋ is outputted from the 640th stage DFF (in FIG. 10, the leftmost DFF is made a first stage DFF), the clock signal is temporarily stopped, and the outputs from the respective DFFs are fixed. At this time, the first latch signal (LP) is inputted. and the outputs of the respective DFFs of the shift registers are stored in the respective storage circuits (LAT). By this operation, the digital picture signals corresponding to the signal lines ⌈R001, R002, . . . , R639, R640⌋ are transferred to the storage circuits (LAT), and at the same time, those signals are outputted to the D/A converter circuits.

Thereafter, the digital picture signals of the second subgroup of "G" and the clock signal are inputted, and when the digital picture signal corresponding to the signal line ⌈G640⌋ is outputted from the 640th stage DFF, the clock signal is temporarily stopped and the outputs from the respective DFFs are fixed. At this time, the second latch signal (LP) is inputted, and the outputs of the respective DFFs of the shift registers are stored in the respective storage circuits (LAT). By this operation. the digital picture signals corresponding to the signal lines ⌈G001, G002, . . . , G639. G640⌋ are transferred to the storage circuits (LAT), and at the same time, those signals are outputted to the D/A converter circuits.

Finally, the digital picture signals of the third subgroup of "B" and the clock signal are inputted and when the digital picture signal corresponding to the signal line ⌈B640⌋ is outputted from the 640th stage DFF, the clock signal is temporarily stopped and the outputs from the respective DFFs are fixed. At this time, the third latch signal (LP) is inputted, and the outputs of the respective DFFs of the shift registers are stored in the respective storage circuits (LAT). By this operation. the digital picture signals corresponding to the signal lines ⌈B001, B002, . . . , B639, B640⌋ are transferred to the storage circuits (LAT), and at the same time, those signals are outputted to the D/A converter circuits.

By the input of the latch signals as described above, all the digital picture signals for one row of the signal lines are transferred to the storage circuits (LAT).

The 3-bit digital signals inputted to the D/A converter circuits are converted into analog signals. The converted analog signals are written into the suitable signal lines through the signal line selecting circuits 10*d*. Hereinafter, this writing timing will be described.

The storage circuits (LAT) repeat the storing operation three times in one horizontal scan period. Thus, in the period when the digital picture signals corresponding to certain signal lines are stored in the storage circuits (LAT), the corresponding signal lines must be selected and writing must be completed.

First, in the period when the digital picture signals corresponding to the signal lines ⌈R001, R002, . . . , R639, R640⌋ as the first subgroup of "R" are stored in the storage circuits (LAT), the first control signal (SS1) is inputted. and the respective signal line selecting circuits 10*d* select the signal lines of ⌈R001, R002, . . . , R639, R640⌋, respectively.

Next, in the period when the digital picture signals corresponding to the signal lines ⌈G001, G002, . . . , G639, G640⌋ as the second subgroup of "G" are stored in the storage circuits (LAT), the second control signal (SS2) is inputted. and the respective signal line selecting circuits 10*d* select the signal lines ⌈G001, G002, . . . , G639, G640⌋, respectively.

Finally, in the period when the digital picture signals corresponding to the signal lines ⌈B001, B002, . . . , B639, B640⌋ as the third subgroup of "B" are stored in the storage circuits (LAT), the third control signal (SS3) is inputted, and the respective signal line selecting circuits 10*d* select the signal lines of ⌈B001, B002, . . . , B639, B640⌋, respectively.

In this way, by inputting the control pulse to the signal line selecting circuits 10*d* three times in one horizontal scan period correspondingly to RGB, it becomes possible to write the outputs of the D/A converter circuits into the suitable signal lines.

Incidentally, a buffer circuit, a level shift circuit, an enable circuit for limiting an output period, or the like may be inserted between the output of the storage circuit (LAT) and the D/A converter circuit. Besides, the input arrangement order of the digital picture signals is not limited to the above order. This arrangement order is determined by an operation method of the signal line selecting circuits, an operation direction of the shift registers (input connection positions of the digital picture signals), or the like. For example, the arrangement order of the signals in the subgroup is reversed according to whether the digital picture signals are inputted to the right of the signal line driver circuit or the left thereof. Besides, in the above, in the case where the timing when the pulse of the first control signal (SS1) of the signal line selecting circuits 10*d* is inputted is exchanged for the timing when the pulse of the third control signal (SS3) is inputted. the input arrangement order of the digital picture signals is also changed such that the first subgroup of "R" is exchanged for the third subgroup of "B".

As described above, in the present invention, although the number of the shift registers is increased, it is possible to drive the image display device by the shift registers each comprised of circuits, the number of which is ⅓ of the related art. the storage circuits, the number of which is ⅙ of the related art, and the D/A converter circuits, the number of which is ⅓ of the related art, so that it becomes possible to greatly reduce the occupied area of the driver circuit and the number of elements. Besides, since the digital picture signal is directly inputted to the shift register. it becomes possible shorten the signal transmission line for supplying the digital picture signal, to make the connected gate capacitance dramatically small, and to decrease the resistance and load capacitance of the signal transmission line.

Embodiment 4

In Embodiment 4, as an example of a manufacturing method in the case where Embodiments 1 to 3 are applied to an active matrix liquid crystal display device. a method of manufacturing a pixel TFT, which is a switching element of a pixel portion and TFTs of a driver circuit (a signal line driver circuit. scan line driver circuit, or the like) formed in the periphery of the pixel portion, on the same substrate, is explained according to the processes. For a brief description, cross section of a CMOS circuit which is a basic structure circuit is illustrated taken along a path in a driver circuit portion, and cross section of an n-channel type TFT is illustrated taken along a path in the pixel TFT of the pixel portion.

Figure 12A:
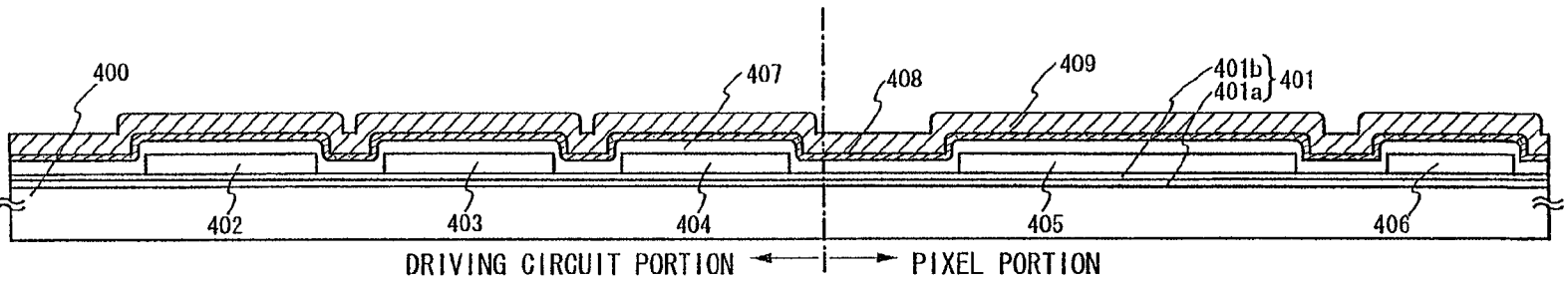
FIGS. 12A to 12C are sectional views showing fabricating steps of TFTs.

First, as shown in FIG. 12A, a base film 401 made of an insulating film such as a silicon oxide film, a silicon nitride film, or a silicon nitride oxide film, is formed on a substrate 400 made from a glass such as barium borosilicate glass or aluminum borosilicate glass, typically a glass such as Corning Corp. #7059 glass or #1737 glass. For example, a lamination film of a silicon nitride oxide film 401*a*. manufactured from $SiH_4$, $NH_3$, and $N_2O$ by plasma CVD, and formed having a thickness of 10 to 200 nm (preferably between 50 and 100 nm), and a hydrogenated silicon nitride oxide film 401*b*, similarly manufactured from $SiH_4$ and $N_2O$, and formed having a thickness of 50 to 200 nm (preferably between 100 and 150 nm), is formed. A two layer structure is shown for the base film 401 in Embodiment 4, but a single layer film of an insulating film, and a structure in which more than two layers are laminated, may also be formed.

Island shape semiconductor layers 402 to 406 are formed by crystalline semiconductor films manufactured from a semiconductor film having an amorphous structure, using a laser crystallization method or a known thermal crystallization method. The thickness of the island shape semiconductor layers 402 to 406 may be formed from 25 to 80 nm (preferably between 30 and 60 nm). There are no limitations placed on the crystalline semiconductor film material, but it is preferable to form the crystalline semiconductor films by silicon or a silicon germanium (SiGe) alloy.

A laser such as a pulse emission type or continuous emission type excimer laser, a YAG laser, or a $YVO_4$ laser can be used in manufacturing the crystalline semiconductor films by the laser crystallization method. A method of condensing laser light emitted from a laser emission device into a linear shape by an optical system and then irradiating the light to the semiconductor film may be used when these types of lasers are used. The crystallization conditions may be suitably selected by the operator, but when using the excimer laser, the pulse emission frequency is set to 30 Hz. and the laser energy density is set form 100 to 400 mJ/cm$^2$ (typically between 200 and 300 mJ/cm$^2$). Further, when using the YAG laser, the second harmonic is used and the pulse emission frequency is set from 1 to 10 KHz, and the laser energy density may be set from 300 to 600 mJ/cm$^2$ (typically between 350 and 500 mJ/cm$^2$). The laser light condensed into a linear shape with a width of 100 to 1000 μm, for example 400 μm. is then irradiated over the entire surface of the substrate. This is performed with an overlap ratio of 80 to 98% for the linear laser light.

A gate insulating film 407 is formed covering the island shape semiconductor layers 402 to 406. The gate insulating film 407 is formed of an insulating film containing silicon with a thickness of 40 to 150 nm by plasma CVD or sputtering. A 120 nm thick silicon nitride oxide film is formed in Embodiment 4. The gate insulating film is not limited to this type of silicon nitride oxide film. of course, and other insulating films containing silicon may also be used in a single layer or in a lamination structure. For example, when using a silicon oxide film, it can be formed by plasma CVD with a mixture of TEOS (tetraethyl orthosilicate) and $O_2$, at a reaction pressure of 40 Pa, with the substrate temperature set from 300 to 400° C., and by discharging at a high frequency (13.56 MHZ) electric power density of 0.5 to 0.8 W/cm$^2$. Good characteristics as a gate insulating film can be obtained by subsequently performing thermal annealing, at between 400 and 500° C., of the silicon oxide film thus manufactured.

A first conductive film 408 and a second conductive film 409 are then formed on the gate insulating film 407 in order to form gate electrodes. The first conductive film 408 is formed of a Ta film with a thickness of 50 to 100 nm. and the second conductive film 409 is formed of a W film having a thickness of 100 to 300 nm. in Embodiment 4.

The Ta film is formed by sputtering, and sputtering of a Ta target is performed by Ar. If appropriate amounts of Xe and Kr are added to Ar at the time of sputtering. the internal stress of the formed Ta film is relaxed, and film peeling can be prevented. The resistivity of an α phase Ta film is on the order of 20 μΩcm, and it can be used in the gate electrode, but the resistivity of a β phase Ta film is on the order of 180 μΩcm and it is unsuitable for the gate electrode. The α phase Ta film can easily be obtained if a tantalum nitride film, which possesses a crystal structure similar to that of α phase Ta, is formed with a thickness of about 10 to 50 nm as a base for a Ta film in order to form the α phase Ta film.

The W film is formed by sputtering with a W target, which can also be formed by thermal CVD using tungsten hexafluoride ($WF_6$). Whichever is used. it is necessary to make the film become low resistance in order to use it as the gate electrode, and it is preferable that the resistivity of the W film be made equal to or less than 20 μΩcm. The resistivity can be lowered by enlarging the crystals of the W film, but for cases in which there are many impurity elements such as oxygen within the W film, crystallization is inhibited, and the film becomes high resistance. A W target having a purity of 99.9999% is thus used in sputtering. In addition, by forming the W film while taking sufficient care that no impurities from the gas phase are introduced at the time of film formation, the resistivity of 9 to 20 μΩcm can be achieved.

Note that, although the first conductive film 408 is a Ta film and the second conductive film 409 is a W film in Embodiment 4, the conductive films are not limited to these, both may also be formed from an element selected from the group consisting of Ta, W, Ti, Mo, Al, and Cu, from an alloy material having one of these elements as its main constituent, or from a chemical compound of these elements. Further. a semiconductor film, typically a polysilicon film into which an impurity element such as phosphorous is doped, may also be used. Examples of preferable combinations other than that used in Embodiment 4 include: forming the first conductive film by tantalum nitride (TaN) and combining it with the second conductive film formed from a W film; forming the first conductive film by tantalum nitride (TaN) and combining it with the second conductive film formed from an Al film; and forming the first conductive film by tantalum nitride (TaN) and combining it with the second conductive film formed from a Cu film.

Then, masks 410 to 417 are formed from resist, and a first etching process is performed in order to form electrodes and wirings. An ICP (inductively coupled plasma) etching method is used in Embodiment 4. A gas mixture of $CF_4$ and $Cl_2$ is used as an etching gas, and a plasma is generated by applying a 500 W RF electric power (13.56 MHZ) to a coil shape electrode at 1 Pa. A 100 W RF electric power (13.56 MHZ) is also applied to the substrate side (test piece stage), effectively applying a negative self-bias voltage. In case of mixing $CF_4$ and $Cl_2$, the W film and the Ta film are etched to the approximately same level.

Edge portions of the first conductive layer and the second conductive layer are made into a tapered shape in accordance with the effect of the bias voltage applied to the substrate side under the above etching conditions by using a suitable resist mask shape. The angle of the tapered portions is from 15 to 45°. The etching time may be increased by approximately 10 to 20% in order to perform etching without any residue remaining on the gate insulating film. The selectivity of a silicon nitride oxide film with respect to a W film is from 2 to 4 (typically 3), and therefore approximately 20 to 50 nm of the exposed surface of the silicon nitride oxide film is etched by this over-etching process. First shape conductive layers 419 to 426 (first conductive layers 419*a* to 426*a* and second conductive layers 419*b* to 426*b*) are thus formed of the first conductive layers and the second conductive layers in accordance with the first etching process. Reference numeral 418 denotes a gate insulating film, and the regions not covered by the first shape conductive layers 419 to 426 are made thinner by etching of about 20 to 50 nm.

Figure 12B:
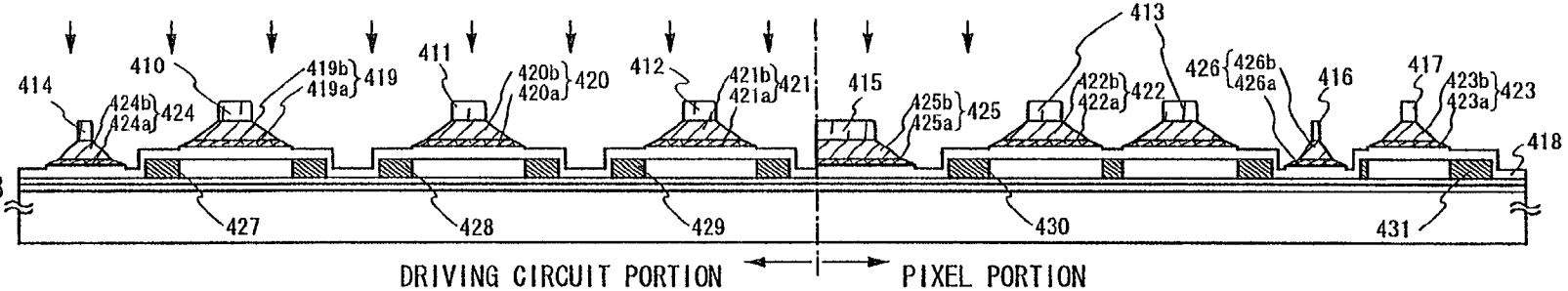

A first doping process is then performed, and an impurity element which imparts n-type conductivity is added. (See FIG. 12B.) Ion doping or ion injection may be performed for the method of doping. Ion doping is performed under the conditions of a dose amount of from $1\times10^{13}$ to $5\times10^{14}$ atoms/cm$^2$ and an acceleration voltage of 60 to 100 keV. A periodic table group 15 element, typically phosphorous (P) or arsenic (As) is used as the impurity element which imparts n-type conductivity, and phosphorous (P) is used here. The conductive layers 419 to 423 become masks with respect to the n-type conductivity imparting impurity element in this case, and first impurity regions 427 to 431 are formed in a self-aligning manner. The impurity element which imparts n-type conductivity is added to the first impurity regions 427 to 431 with a concentration in the range of $1\times10^{20}$ to $1\times10^{21}$ atoms/cm$^3$.

Figure 12C:
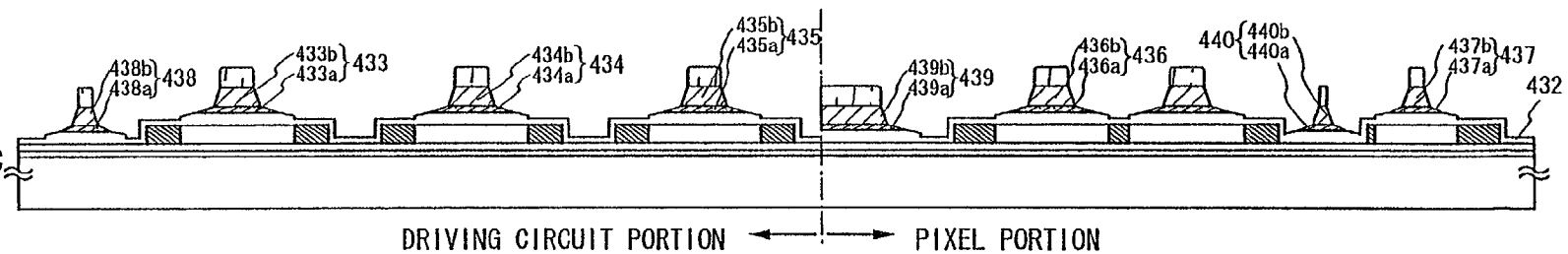

A second etching process is performed next, as shown in FIG. 12C. The ICP etching method is similarly used, a mixture of $CF_4$, $Cl_2$, and $O_2$ is used as the etching gas, and a plasma is generated by supplying a 500 W RF electric power (13.56 MHZ) to a coil shape electrode at a pressure of 1 Pa. A 50 W RF electric power (13.56 MHZ) is applied to the substrate side (test piece stage), and a self-bias voltage which is lower in comparison to that of the first etching process is applied. The W film is etched anisotropically under these etching conditions, and Ta (the first conductive layers) is anisotropically etched at a slower etching speed, forming second shape conductive layers 433 to 440 (first conductive layers 433*a* to 440*a* and second conductive layers 433*b* to 440*b*). Reference numeral 432 denotes a gate insulating film. and regions not covered by the second shape conductive layers 433 to 437 are additionally etched on the order of 20 to 50 nm, forming thinner regions.

The etching reaction of a W film or a Ta film in accordance with a mixed gas of $CF_4$ and $Cl_2$ can be estimated from the radicals generated and from the ion types and vapor pressures of the reaction products. Comparing the vapor pressures of fluorides and chlorides of W and Ta, the W fluoride compound $WF_6$ is extremely high, and the vapor pressures of $WCl_5$, $TaF_5$. and $TaCl_5$ are of similar order. Therefore the W film and the Ta film are both etched by the $ClF_4$ and $Cl_2$ gas mixture. However, if a suitable quantity of $O_2$ is added to this gas mixture, $CF_4$ and $O_2$ react, forming CO and F, and a large amount of F radicals or F ions is generated. As a result, the etching speed of the W film having a high fluoride vapor pressure is increased. On the other hand, even if F increases, the etching speed of Ta does not relatively increase. Further, Ta is easily oxidized compared to W, and therefore the surface of Ta is oxidized by the addition of $O_2$. The etching speed of the Ta film is further reduced because Ta oxides do not react with fluorine and chlorine. It therefore becomes possible to have a difference in etching speeds between the W film and the Ta film, and it becomes possible to make the etching speed of the W film larger than that of the Ta film.

Figures 13A, 13B, 13C:
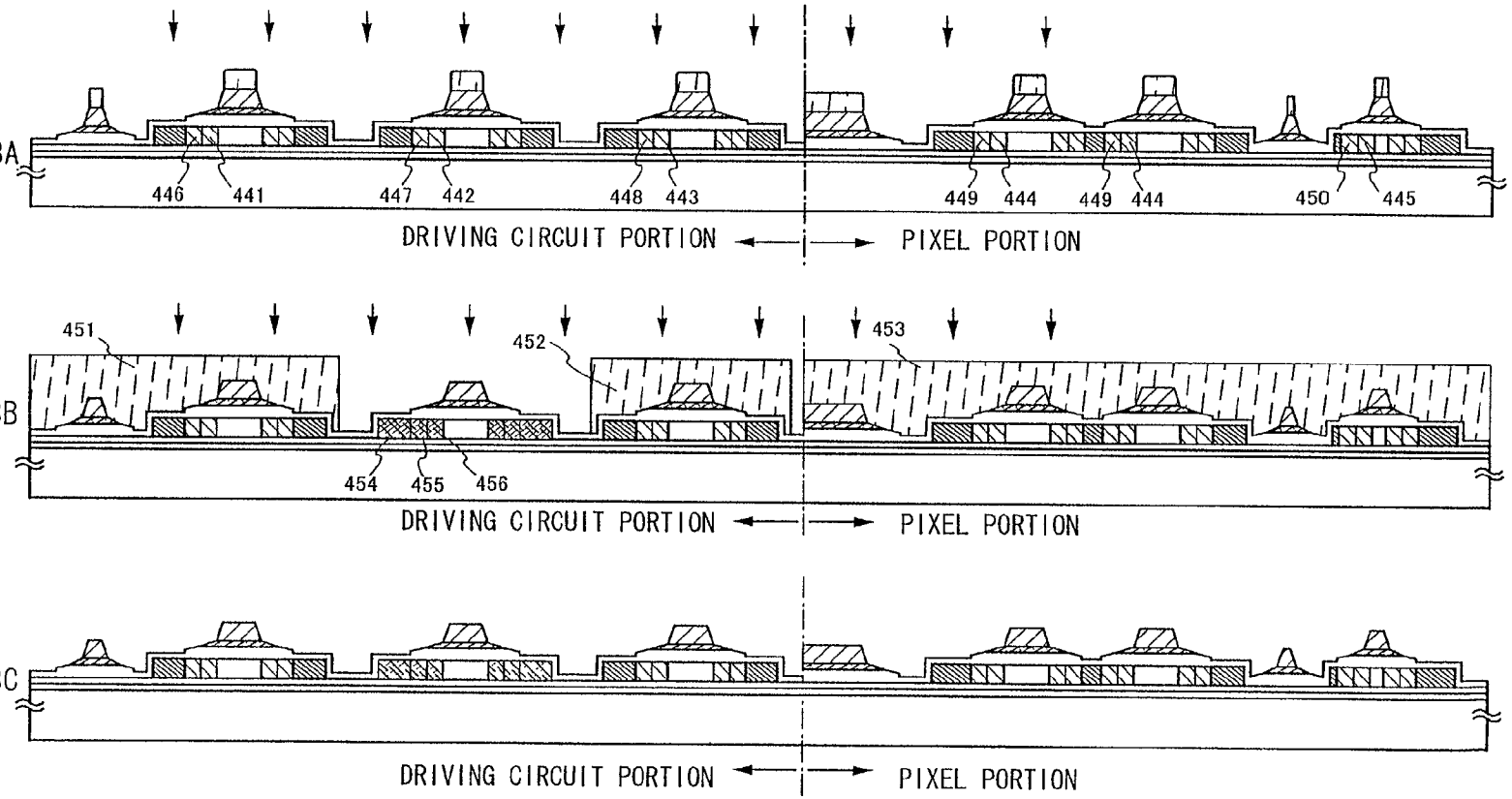
FIGS. 13A to 13C are sectional views showing fabricating steps of the TFTs.

A second doping process is then performed, as shown in FIG. 13A. The dose amount is made smaller than that of the first doping process in this case, and an impurity element which imparts n-type conductivity is doped under high acceleration voltage conditions. For example, doping is performed with the acceleration voltage set from 70 to 120 keV, and a dose amount of $1\times10^{13}$ atoms/cm$^3$, and a new impurity region is formed inside the first impurity region formed in the island shape semiconductor layers of FIG. 12B. The second conductive layers 433 to 437 are used as masks with respect to the impurity element, and doping is performed so as to also add the impurity element into regions under the first conductive layers 433*a* to 437*a*. In this way, third impurity regions 441 to 445 that overlap the first conductive layers 433*a* to 437*a*, and second impurity regions 446 to 450 between the first impurity regions and the third impurity regions are thus formed. The impurity element which imparts n-type conductivity is added such that the concentration becomes from $1\times10^{17}$ to $1\times10^{19}$ atoms/cm$^3$ in the second impurity regions, and becomes from $1\times10^{16}$ to $1\times10^{18}$ atoms/cm$^3$ in the third impurity regions.

Fourth impurity regions 454 to 456 added with an impurity element having a conductivity type which is the opposite of the above conductive type impurity element, are then formed as shown in FIG. 13B in the island shape semiconductor layers 403 which form p-channel TFTs. The second conductive layer 434 is used as a mask with respect to the impurity element, and the impurity regions are formed in a self-aligning manner. The island shape semiconductor layers 402, 404, 405 and 406, which form n-channel TFTs, are covered over their entire surface areas by resist masks 451 to 453. Phosphorous is added in differing concentration to the impurity regions 454 to 456. and ion doping is performed here using diborane ($B_2H_6$), so that the impurity concentration in the regions becomes from $2\times10^{20}$ to $2\times10^{21}$ atoms/cm$^3$.

Impurity regions are formed in the respective island shape semiconductor layers by the above processes. The conductive layers 433 to 436 overlapping the island shape semiconductor layers function as gate electrodes of TFTs. Further. reference numeral 439 functions as a signal line, 440 functions as a scan line, 437 functions as a capacitor wiring, and 438 functions as a driver circuit.

A process of activating the impurity elements added to the respective island shape semiconductor layers is then performed, as shown in FIG. 13C, with the aim of controlling conductivity type. Thermal annealing using an annealing furnace is performed for this process. In addition, laser annealing and rapid thermal annealing (RTA) can also be applied. Thermal annealing is performed with an oxygen concentration equal to or less than 1 ppm, preferably equal to or less than 0.1 ppm. in a nitrogen atmosphere at 400 to 700° C., typically between 500 and 600° C. Heat treatment is performed for 4 hours at 500° C. in Embodiment 4. However, for cases in which the wiring material used in the wirings 433 to 440 is weak with respect to heat, it is preferable to perform activation after forming an interlayer insulating film (having silicon as its main constituent) in order to protect the wirings and the like.

In addition, heat treatment is performed for 1 to 12 hours at 300 to 450° C. in an atmosphere containing between 3 and 100% hydrogen, performing hydrogenation of the island shape semiconductor layers. This process is one of terminating dangling bonds in the island shape semiconductor layers by hydrogen which is thermally excited. Plasma hydrogenation (using hydrogen excited by a plasma) may also be performed as another means of hydrogenation.

Then, a first interlayer insulating film 457 is formed of a silicon nitride oxide film having a thickness of 100 to 200 nm. A second interlayer insulating film 458 made of an organic insulating material is then formed on the first interlayer insulating film 457. Etching is then performed in order to form contact holes.

Source wirings 459 to 461 for forming contact with source regions. and drain wirings 462 to 464 for forming contact with drain regions, of the island shape semiconductor layers in a driver circuit portion are then formed. Further, in a pixel portion, pixel electrodes 466 and 467, and a connection electrode 465 are formed. (See FIG. 14.) An electrical connection is made, in accordance with the connection electrode 465, between the signal line 439 and the a pixel TFT 504. The pixel electrode 466 forms electrical connections with the island shape semiconductor layer 405 corresponding to the active layer of the pixel TFT (corresponding to the first semiconductor layer 201 in FIG. 1) and the island shape semiconductor layer forming a storage capacitor (not shown in figure), respectively. Note that a pixel electrode 467 and a storage capacitance 505 are shared between adjacent pixels.

The driver circuit portion having an n-channel TFT 501, a p-channel TFT 502, and an n-channel TFT 503; and the pixel portion having the pixel TFT 504 and the storage capacitor 505 can thus be formed on the same substrate. For convenience. this type of substrate is referred to as an active matrix substrate throughout this specification.

The n-channel TFT 501 of the driver circuit portion has: a channel forming region 468; the third impurity region 441 overlapping the conductive layer 433, which forms a gate electrode, (GOLD region); the second impurity region 446 formed outside the gate electrode (LDD region); and the first impurity region 427 which functions as a source region or a drain region. The p-channel TFT 502 has: a channel forming region 469; the fourth impurity region 456 overlapping the conductive layer 434, which forms a gate electrode; the fourth impurity region 455 formed outside the gate electrode; and the fourth impurity region 454 which functions as a source region or a drain region. The n-channel TFT 503 has: a channel forming region 470; the third impurity region 443 overlapping the conductive layer 435, which forms a gate electrode, (GOLD region); the second impurity region 448 formed outside the gate electrode (LDD region); and the first impurity region 429 which functions as a source region or a drain region.

The pixel TFT 504 of the pixel portion has: a channel forming region 471; the third impurity region 444 overlapping the conductive layer 436, which forms a gate electrode, (GOLD region); the second impurity region 449 formed outside the gate electrode (LDD region): and the first impurity region 430 which functions as a source region or a drain region. Further, an impurity element which imparts n-type conductivity is added: to the semiconductor layer 431. which functions as one electrode of the storage capacitor 505, at the same concentration as in the first impurity regions; to the semiconductor layer 445 at the same concentration as in the third impurity regions; and to the semiconductor layer 450 at the same concentration as in the second impurity regions. The storage capacitor is formed by the capacitor wiring 437 and an insulating layer therebetween (the same layer as the gate insulating film).

Further, in the present embodiment, edge portions of the pixel electrode are arranged so as to overlap the signal line and the scan line in order that the gaps between the pixel electrodes can be shielded from light without using a black matrix.

Furthermore, in accordance with the processes shown in Embodiment 4, the active matrix substrate can be manufactured by using five photomasks (an island shape semiconductor layer pattern, a first wiring pattern (scan line, signal line, capacitor wirings), an n-channel region mask pattern, a contact hole pattern. and a second wiring pattern (including pixel electrodes and connection electrodes). As a result. the processes can be reduced, and this contributes to a reduction in the manufacturing costs and an increase in throughput.

Embodiment 5

Figure 15:
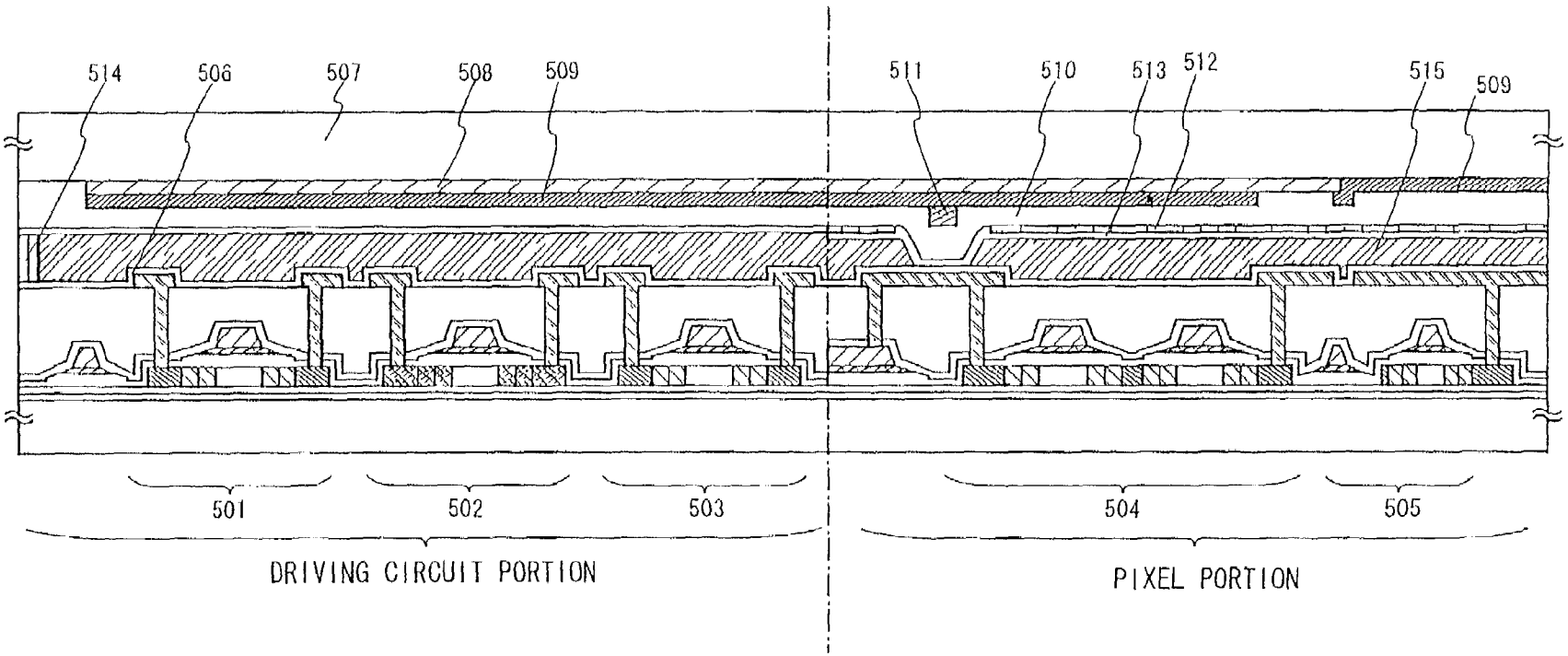
FIG. 15 is a view showing a sectional structure of an active matrix type liquid crystal display device.

A process of manufacturing an active matrix liquid crystal display device from the active matrix substrate manufactured in Embodiment 4 is explained below in Embodiment 5. FIG. 15 is used for the explanation.

Figure 14:
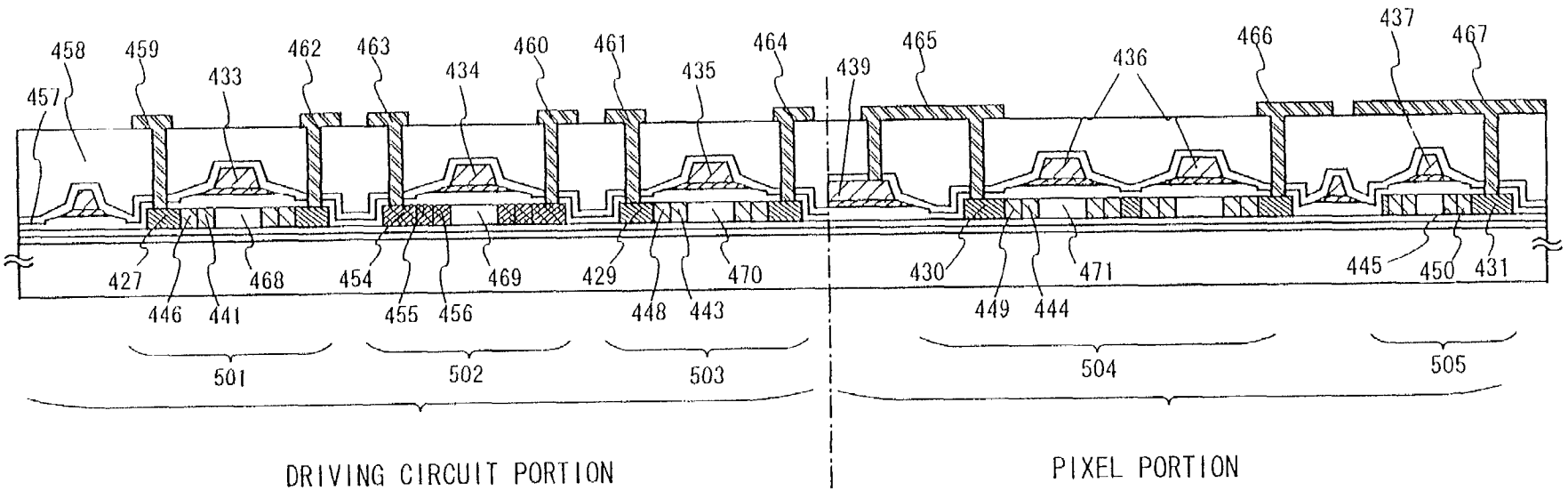
FIG. 14 is a sectional view of an active matrix substrate.

After first obtaining the active matrix substrate of FIG. 14 in accordance with Embodiment 4. an orientation film 506 is formed on the active matrix substrate of FIG. 14, and a rubbing process is performed.

An opposing substrate 507 is prepared. Color filter layers 508 and 509, and an overcoat layer 510 are formed on the opposing substrate 507. The color filter layers are formed such that the color filter layer 508, having a red color, and the color filter 509, having a blue color, are overlapped with each other, and also serve as a light shielding film. It is necessary to shield at least the spaces between the TFTs, and the connection electrodes and the pixel electrodes when using the substrate of Embodiment 4, and therefore, it is preferable that the red color filters and the blue color filters are arranged so as to overlap and shield the necessary positions.

Further, combined with the connection electrode 465, the red color filter layer 508, the blue color filter layer 509, and a green color filter layer 511 are overlaid, forming a spacer. Each color filter is formed having a thickness of 1 to 3 μm by mixing a pigment into an acrylic resin. A predetermined pattern can be formed using a mask which uses a photosensitive material. Considering the thickness of the overcoat layer 510 of 1 to 4 μm, the height of the spacers can be made from 2 to 7 μm, preferably between 4 and 6 μm. A gap is formed by this height when the active matrix substrate and the opposing substrate are joined together. The overcoat layer 510 is formed by an optical hardening, or a thermosetting, organic resin material. and materials such as polyimide and acrylic resin are used, for example.

The arrangement of the spacers may be determined arbitrarily, and the spacers may be arranged on the opposing substrate so as to line up with positions over the connection electrodes, as shown in FIG. 15, for example. Further, the spacers may also be arranged on the opposing substrate so as to line up with positions over the TFTs of the driver circuit. The spacers may be arranged over the entire surface of the driver circuit portion, and they may be arranged so as to cover source wirings and drain wirings.

An opposing electrode 512 is formed by patterning after forming the overcoat layer 510, and a rubbing process is performed after forming an orientation film 513.

The active matrix substrate on which the pixel portion and the driver circuit portion are formed, and the opposing substrate are then joined together by a sealant 514. A filler is mixed into the sealant 514, and the two substrates are joined together with a uniform gap maintained by the filler and the spacers. A liquid crystal material 515 is then injected between both the substrate, and this is completely sealed by using a sealing material (not shown in the figure). A known liquid crystal material 515 may be used as the liquid crystal material. The active matrix liquid crystal display device shown in FIG. 15 is thus completed.

Note that the TFT formed in accordance with the above processes has a top gate structure, and the present invention can be applied also to a TFT having a bottom gate structure or other structure.

In addiction, the present invention can be applied to a self-emission type image display device, namely, an EL display device using an electroluminescence material (EL: Electro Luminescence) instead of a liquid crystal material.

Embodiment 6

In this embodiment, an example in which an EL (electroluminescence) display device, also called a light emitting device or a light emitting diode, is fabricated by using Embodiments 1 to 3 will be described. The EL devices referred to in this specification include triplet-based light emission devices and/or singlet-based light emission devices, for example.

Figure 16A:
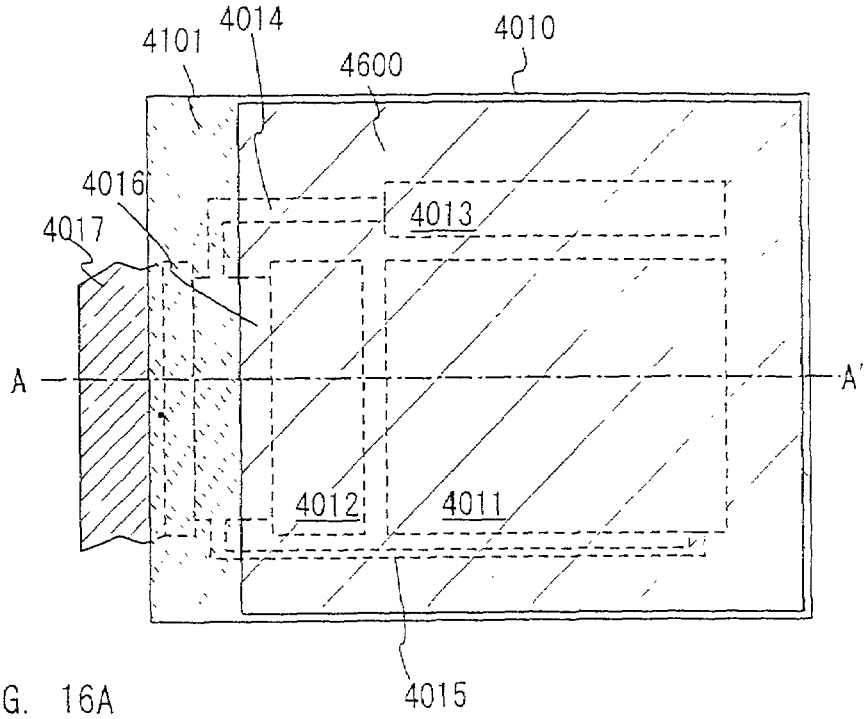
FIGS. 16A and 16B are views showing a fabrication example of an EL display device.
Figure 16B:
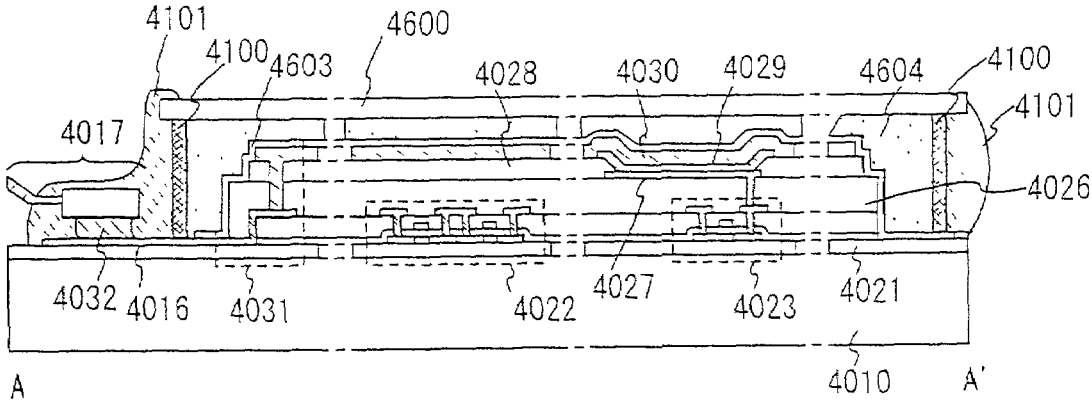

FIG. 16A is a top view of an EL display device using the present invention. FIG. 16B is a cross sectional view of the EL display device taken along line A-A' of FIG. 16A. In FIG. 16A, reference numeral 4010 designates a substrate: 4011, a pixel portion; 4012, a signal line driver circuit; and 4013, a scan line driver circuit, and the respective driver circuits lead to an FPC 4017 through wirings 4014 to 4016 and are connected to an external equipment.

At this time, a cover member 4600, a sealing member (also called a housing member) 4100, and a sealant (second sealing member) 4101 are provided so as to surround at least the pixel portion, preferably the driver circuits and the pixel portion.

Further, as shown in FIG. 16B, a driver circuit TFT (here. a CMOS circuit of a combination of an n-channel TFT and a p-channel TFT is shown) 4022 and a pixel portion TFT 4023 (here, only a TFT for controlling a current to an EL element is shown) are formed on the substrate 4010 and an under film 4021. These TFTs may be formed by using a well-known structure (top gate structure or bottom gate structure).

When the driver circuit TFT 4022 and the pixel portion TFT 4023 are completed by using well-known method, a pixel electrode 4027 electrically connected to a drain of the pixel portion TFT 4023 and made of a transparent conductive film is formed on an interlayer insulating film (flattening film) 4026 made of resin material. As the transparent conductive film, a compound (called ITO) of indium oxide and tin oxide or a compound of indium oxide and zinc oxide can be used. After the pixel electrode 4027 is formed, an insulating film 4028 is formed, and an opening portion is formed over the pixel electrode 4027.

Next, an EL layer 4029 is formed. As the EL layer 4029, a laminate structure or a single layer structure may be adopted by freely combining well-known EL materials (hole injecting layer, hole transporting layer. light emitting layer, electron transporting layer, and electron injecting layer). A well-known technique may be used to determine the structure. The EL material includes a low molecular material and a high molecular (polymer) material. In the case where the low molecular material is used, an evaporation method is used. In the case where the high molecular material is used, it is possible to use a simple method such as a spin coating method, a printing method or an ink jet method.

In this embodiment, the EL layer is formed by the evaporation method using a shadow mask. Color display becomes possible by forming light emitting layers (red light emitting layer, green light emitting layer, and blue light emitting layer), which can emit lights with different wavelengths, for every pixel by using the shadow mask. In addition, there are a system in which a color conversion layer (CCM) and a color filter are combined, and a system in which a white light emitting layer and a color filter are combined, and either system may be used. Of course, an EL display device of monochromatic light emission may be used.

After the EL layer 4029 is formed, a cathode 4030 is formed thereon. It is desirable to remove moisture and oxygen existing in the interface between the cathode 4030 and the EL layer 4029 to the utmost. Thus, it is necessary to make such contrivance that the EL layer 4029 and the cathode 4030 are continuously formed in vacuum, or the EL layer 4029 is formed in an inert gas atmosphere and the cathode 4030 is formed without releasing to the atmosphere. In this embodiment, a film formation apparatus of a multi-chamber system (cluster tool system) is used, so that the foregoing film formation is made possible.

Incidentally, in this embodiment, a laminate structure of a LiF (lithium fluoride) film and an Al (aluminum) film is used for the cathode 4030. Specifically, the LiF (lithium fluoride) film having a thickness of 1 nm is formed on the EL layer 4029 by the evaporation method, and the aluminum film having a thickness of 300 nm is formed thereon. Of course, a MgAg electrode of a well-known cathode material may be used. The cathode 4030 is connected to the wiring 4016 in a region designated by 4031. The wiring 4016 is a power supply line for giving a predetermined voltage to the cathode 4030, and is connected to the FPC 4017 through a conductive paste material 4032.

For the purpose of electrically connecting the cathode 4030 to the wiring 4016 in the region 4031, it is necessary to form contact holes in the interlayer insulating film 4026 and the insulating film 4028. These may be formed at the time of etching the interlayer insulating film 4026 (at the time of forming the contact hole for the pixel electrode) and at the time of etching the insulating film 4028 (at the time of forming the opening portion before formation of the EL layer). When the insulating film 4028 is etched, the interlayer insulating film 4026 may be etched together. In this case, if the interlayer insulating film 4026 and the insulating film 4028 are made of the same resin material, the shape of the contact hole can be made excellent.

A passivation film 4603, a filler 4604, and a cover member 4600 are formed to cover the surface of the EL element formed in this way.

Further, the sealing member 4100 is provided at the inside of the cover member 4600 and the substrate 4010 in such a manner as to cover the EL element portion, and further, the sealant (second sealing member) 4101 is formed at the outside of the sealing member 4100.

At this time, this filler 4604 functions also as an adhesive for bonding the cover member 4600. As the filler 4604, PVC (polyvinyl chloride), epoxy resin, silicone resin, PVB (polyvinyl butyral) or EVA (ethylene-vinyl acetate) can be used. It is preferable that a drying agent is provided in the inside of this filler 4604 because a moisture absorption effect can be held.

A spacer may be contained in the filler 4604. At this time. the spacer may be made a granular material of BaO or the like, and the spacer itself may be made to have a moisture absorption property.

In the case where the spacer is provided, the passivation film 4603 can relieve spacer pressure. In addition to the passivation film, a resin film or the like for relieving the spacer pressure may be provided.

As the cover member 4600, a glass plate, an aluminum plate, a stainless plate, an FRP (Fiberglass-Reinforced Plastics) plate, a PVF (polyvinyl fluoride) film, a Mylar film, a polyester film, or an acrylic film can be used. In the case where PVB or EVA is used for the filler 4604, it is preferable to use a sheet of a structure in which an aluminum foil of several tens of mm is put between PVF films or Mylar films.

However, according to the direction of light emission (radiation direction of light) from the EL element, it is necessary that the cover member 4600 has transparency.

The wiring 4016 is electrically connected to the FPC 4017 through the gap between the sealing member 4100 or the sealant 4101 and the substrate 4010. Incidentally, here, although the description has been made on the wiring 4016, the other wirings 4014 and 4015 are also electrically connected to the FPC 4017 under the sealing member 4100 and the sealant 4101 in the same way.

In Embodiment 6, the covering material 4600 is bonded after forming the filler 4604, and the sealing material 4100 is attached so as to cover the side surfaces (exposed surfaces) of the filler 4604, but the filler 4604 may also be formed after attaching the covering material 4600 and the sealing material 4100. In this case, a filler injection opening is formed through a gap formed by the substrate 4010, the covering material 4600, and the sealing material 4100. The gap is set into a vacuum state (a pressure equal to or less than $10^{-2}$ Torr), and after immersing the injection opening in the tank holding the filler, the air pressure outside of the gap is made higher than the air pressure within the gap, and the filler fills the gap.

Embodiment 7

In this embodiment, an example in which an EL display device different from Embodiment 6 is fabricated by using the present invention will be described with reference to FIGS. 17A and 17B. Since the same reference numerals as those of FIGS. 16A and 16B designate the same portions, the explanation is omitted.

Figure 17A:
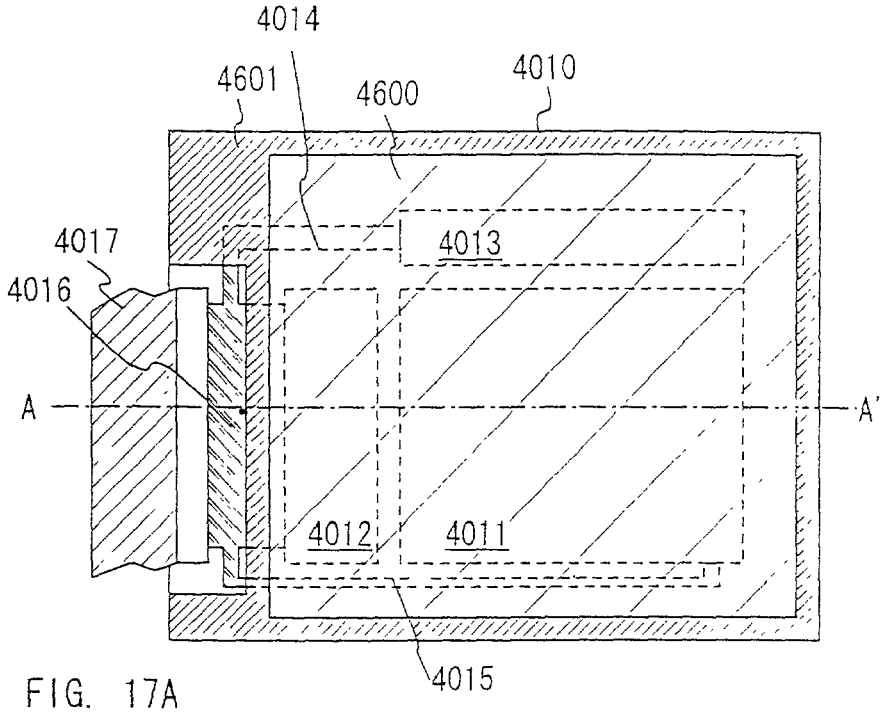
FIGS. 17A and 17B are views showing a fabrication example of an EL display device.
Figure 17B:
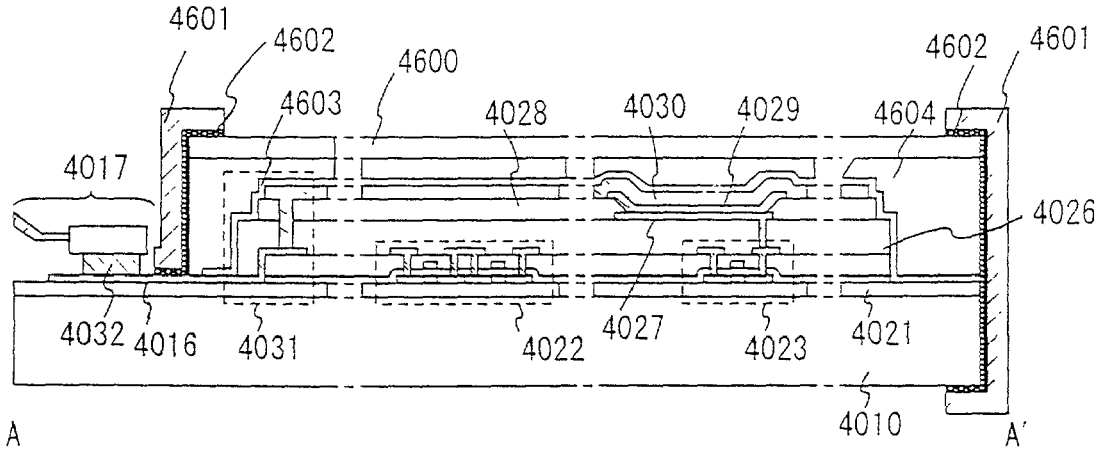

FIG. 17A is a top view of an EL display device of this embodiment, and FIG. 17B is a sectional view taken along line A-A' of FIG. 17A.

In accordance with Embodiment 6, steps are carried out until a passivation film 4603 covering the surface of an EL element is formed.

Further, a filler 4604 is provided so as to cover the EL element. This filler 4604 functions also as an adhesive for bonding a cover member 4600. As the filler 4604, PVC (polyvinyl chloride), epoxy resin, silicon resin, PVB (polyvinyl butyral) or EVA (ethylene-vinyl acetate) can be used. It is preferable that a drying agent is provided in the inside of this filler 4604, since a moisture absorption effect can be held.

A spacer may be contained in the filler 4604. At this time. the spacer may be made a granular material of BaO or the like, and the spacer itself may be made to have a moisture absorption property.

In the case where the spacer is provided, the passivation film 4603 can relieve spacer pressure. In addition to the passivation film, a resin film or the like for relieving the spacer pressure may be provided.

As the cover member 4600, a glass plate, an aluminum plate, a stainless plate, an FRP (Fiberglass-Reinforced Plastics) plate, a PVF (polyvinyl fluoride) film, a Mylar film, a polyester film, or an acrylic film can be used. In the case where PVB or EVA is used for the filler 4604, it is preferable to use a sheet of a structure in which an aluminum foil of several tens of mm is put between PVF films or Mylar films.

However, according to the direction of light emission (radiation direction of light) from the EL element, it is necessary that the cover member 4600 has transparency.

Next, after the cover member 4600 is bonded by using the filler 4604, a frame member 4601 is attached so as to cover the side (exposed surface) of the filler 4604. The frame member 4601 is bonded by a sealing member (functioning as an adhesive) 4602. At this time, as the sealing member 4602, although it is preferable to use a photo-curing resin, if heat resistance of the EL layer permits, a thermosetting resin may be used. Incidentally, it is desirable that the sealing member 4602 is a material which is as impermeable as possible to moisture and oxygen. A drying agent may be added in the inside of the sealing member 4602.

A wiring line 4016 is electrically connected to an FPC 4017 through a gap between the sealing member 4602 and a substrate 4010. Here, although description has been made on the wiring 4016, other wirings 4014 and 4015 are also electrically connected to the FPC 4017 through a space under the sealing member 4602 in the same manner.

In Embodiment 7, the covering material 4600 is bonded after forming the filler 4604, and the frame material 4601 is attached so as to cover the side surfaces (exposed surfaces) of the filler 4604, but the filler 4604 may also be formed after attaching the covering material 4600 and the frame material 4601. In this case, a filler injection opening is formed through a gap formed by the substrate 4010, the covering material 4600, and the frame material 4601. The gap is set into a vacuum state (a pressure equal to or less than $10^{-2}$ Torr), and after immersing the injection opening in the tank holding the filler, the air pressure outside of the gap is made higher than the air pressure within the gap, and the filler fills the gap.

Embodiment 8

Figure 18:
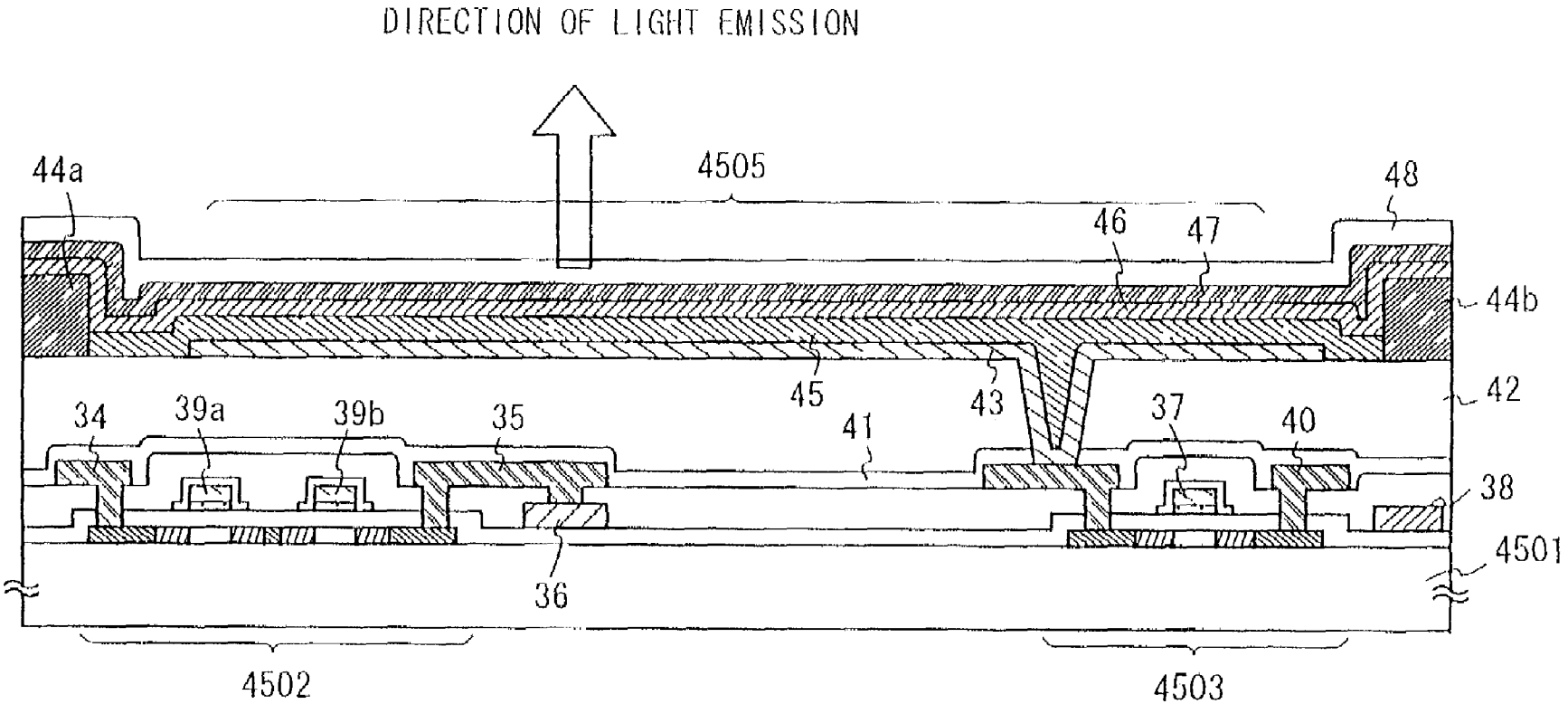
FIG. 18 is a view showing a fabrication example of an EL display device.
Figure 19A:
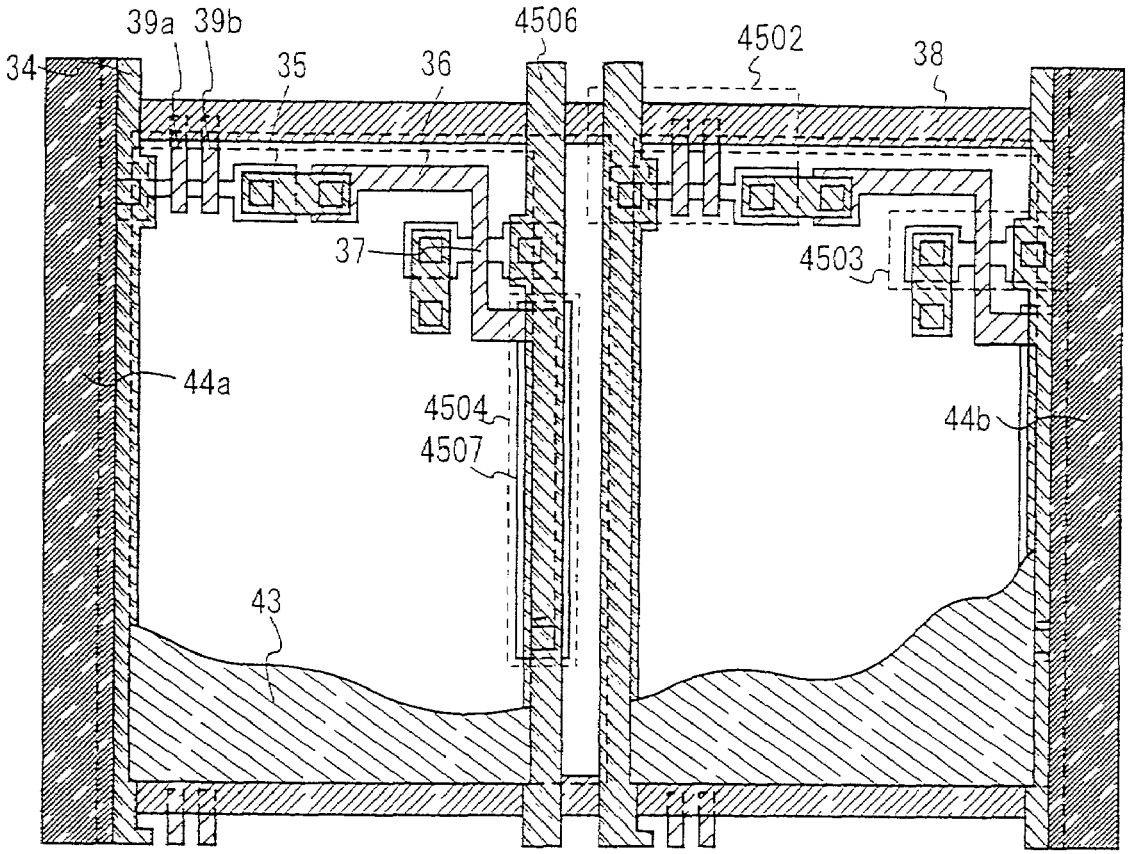
FIGS. 19A and 19B are views showing a fabrication example of an EL display device.
Figure 19B:
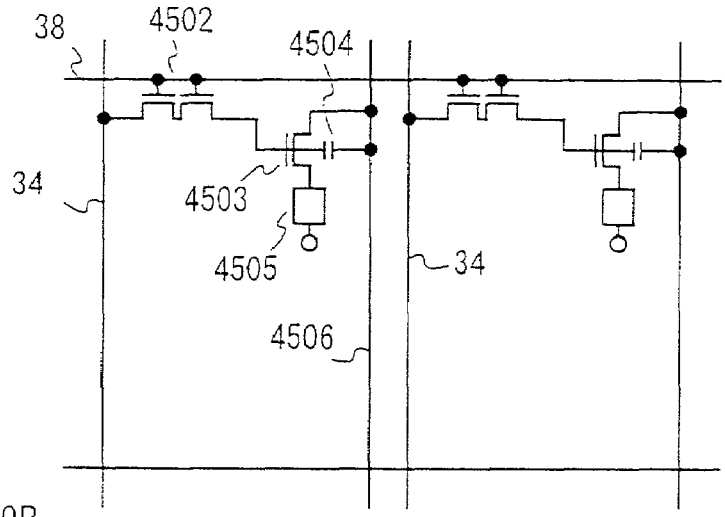

Here, a more detailed sectional structure of a pixel portion of an EL display device is shown in FIG. 18, its upper structure is shown in FIG. 19A, and its circuit diagram is shown in FIG. 19B. In FIGS. 18, 19A and 19B, since common characters are used, reference may be made to one another.

In FIG. 18, a switching TFT 4502 provided on a substrate 4501 is formed by using an n-channel TFT formed by a known method. In this embodiment, although a double gate structure is used, since there is no big difference in the structure and fabricating process, explanation is omitted. However, a structure in which two TFTs are essentially connected in series with each other is obtained by adopting the double gate structure, and there is a merit that an off current value can be decreased. Incidentally, although the double gate structure is adopted in this embodiment, a single gate structure may be adopted, or a triple gate structure or a multi-gate structure having more gates may be adopted. Further, it may be formed by using a p-channel TFT formed by a known method.

A current controlling TFT 4503 is formed by using an n-channel TFT formed by a known method. reference numeral 34 shows a source wiring (signal line) of the switching TFT 4502, and reference numeral 35 shows a drain wiring of the switching TFT 4502 and is electrically connected to a gate electrode 37 of the current controlling TFT through a wiring 36. A wiring designated by 38 is a gate wiring (scan line) for electrically connecting gate electrodes 39*a* and 39*b* of the switching TFT 4502.

At this time, since the current controlling TFT 4503 is an element for controlling the amount of current flowing through an EL element, a large current flows. and it is an element having high fear of deterioration due to heat or deterioration due to hot carriers. Thus, it is very effective to adopt a structure in which an LDD region is provided at a drain side of the current controlling TFT 4503 so as to overlap with a gate electrode through a gate insulating film.

In this embodiment, although the current controlling TFT 4503 is shown as a single gate structure, a multi-gate structure in which a plurality of TFTs are connected in series with each other may be adopted. Further, such a structure may be adopted that a plurality of TFTs are connected in parallel with each other to essentially divide a channel forming region into plural portions, so that radiation of heat can be made at high efficiency. Such structure is effective as a countermeasure against deterioration due to heat.

Further, as shown in FIG. 19A, the wiring 36 which becomes the gate electrode 37 of the current controlling TFT 4503 overlaps with a drain wiring 40 of the current controlling TFT 4503 through an insulating film in a region designated by 4504. At this time, a capacitor is formed in the region 4504 and functions as a storage capacitor for holding voltage applied to the gate electrode 37 of the current controlling TFT 4503. The storage capacitor 4504 is formed between the semiconductor film 4507 connected electrically to the power supply line 4506, an insulating film (not shown in figures) which is the same layer of the gate insulating film, and the wiring 36. Further, the capacitor, which is formed from the wiring 36, the same layer (not shown in figures) of a first interlayer insulating film and the power supply line 4506 can be also used as a storage capacitor. The drain of the current controlling TFT is connected to the power supply line (power source line) 4506 so as to be always supplied with a constant voltage.

A first passivation film 41 is provided on the switching TFT 4502 and the current controlling TFT 4503, and a flattening film 42 made of a resin insulating film is formed thereon. It is very important to flatten a stepped portion due to the TFT by using the flattening film 42. Since an EL layer formed later is very thin, there is a case where light emission defect occurs due to the existence of the stepped portion. Thus, it is desirable to conduct flattening prior to formation of a pixel electrode so that the EL layer can be formed on the flat surface.

Reference numeral 43 designates a pixel electrode (cathode of the EL element) made of a conductive film having high reflectivity, and is electrically connected to the drain of the current controlling TFT 4503. As the pixel electrode 43, it is preferable to use a low resistance conductive film, such as an aluminum alloy film, a copper alloy film or a silver alloy film, or a laminate film of those. Of course, a laminate structure with another conductive film may be adopted.

A light emitting layer 45 is formed in a groove (corresponding to a pixel) formed by banks 44*a* and 44*b* made of insulating films (preferably resin). In FIG. 19A. a portion of bank is eliminated to clarify the position of the storage capacitor 4504, so only the bank 44*a* and 44*b* are shown in figures. The banks are provided between the power supply line 4506 and the source wiring (signal line) 34 to overlap the portion of the power supply line 4506 and the source wiring (signal line) 34. Herein, only two pixels are shown, however, light-emitting layers corresponding to each color R (red), G (green), and B (blue)) may be formed. As an organic EL material used for the light-emitting layer, a π-conjugate polymer material is used. Typical examples of the polymer material include polyparaphenylene vinylene (PPV), polyvinyl carbazole (PVK), and polyfluorene.

Although various types exist as the PPV organic EL material, for example, a material as disclosed in "H. Shenk, H. Becker, O Gelsen, E. Kluge, W. Kreuder, and H. Spreitzer, "Polymers for Light Emitting Diodes", Euro Display, Proceedings, 1999, p. 33-37" or Japanese Patent Application Laid-open No. Hei. 10-92576 may be used.

As a specific light emitting layer, it is appropriate that cyanopolyphenylenevinylene is used for a light emitting layer emitting red light, polyphenylenevinylene is used for a light emitting layer emitting green light, and polyphenylenevinylene or polyalkylphenylene is used for a light emitting layer emitting blue light. It is appropriate that the film thickness is made 30 to 150 nm (preferably 40 to 100 nm).

However, the above examples are an example of the organic EL material which can be used for the light emitting layer, and it is not necessary to limit the invention to these. The EL layer (layer in which light emission and movement of carriers for that are performed) may be formed by freely combining a light emitting layer, a charge transporting layer and a charge injecting layer.

For example, although this embodiment shows the example in which the polymer material is used for the light emitting layer, a low molecular organic EL material may be used. It is also possible to use an inorganic material, such as silicon carbide, as the charge transporting layer or the charge injecting layer. As the organic EL material or inorganic material, a well-known material can be used.

This embodiment adopts the EL layer of a laminate structure in which a hole injecting layer 46 made of PEDOT (polythiophene) or PAni (polyaniline) is provided on the light emitting layer 45. An anode 47 made of a transparent conductive film is provided on the hole injecting layer 46. In the case of this embodiment. since light generated in the light emitting layer 45 is radiated to an upper surface side (to the upper side of the TFT), the anode must be translucent. As the transparent conductive film. a compound of indium oxide and tin oxide or a compound of indium oxide and zinc oxide can be used. However, since the film is formed after the light emitting layer and the hole injecting layer having low heat resistance is formed. it is preferable that film formation can be made at the lowest possible temperature.

At the point when the anode 47 has been formed, an EL element 4505 is completed. Incidentally, the EL element 4505 here indicates a capacitor formed of the pixel electrode (cathode) 43, the light emitting layer 45, the hole injecting layer 46 and the anode 47. As shown in FIG. 19A, since the pixel electrode 43 is almost coincident with the area of the pixel, the whole pixel functions as the EL element. Thus, use efficiency of light emission is very high, and bright image display becomes possible.

In this embodiment, a second passivation film 48 is further provided on the anode 47. As the second passivation film 48, a silicon nitride film or a silicon nitride oxide film is desirable. This object is to insulate the EL element from the outside. and has both the meaning of preventing deterioration due to oxidation of the organic EL material and the meaning of suppressing degassing from the organic EL material. By doing this, the reliability of the EL display device is improved.

As described above, the EL display device includes the pixel portion made of the pixel of the structure as shown in FIG. 18, and includes the switching TFT having a sufficiently low off current value and the current controlling TFT resistant to hot carrier injection. Thus, it is possible to obtain the EL display panel which has high reliability and can make excellent image display.

Embodiment 9

Figure 20:
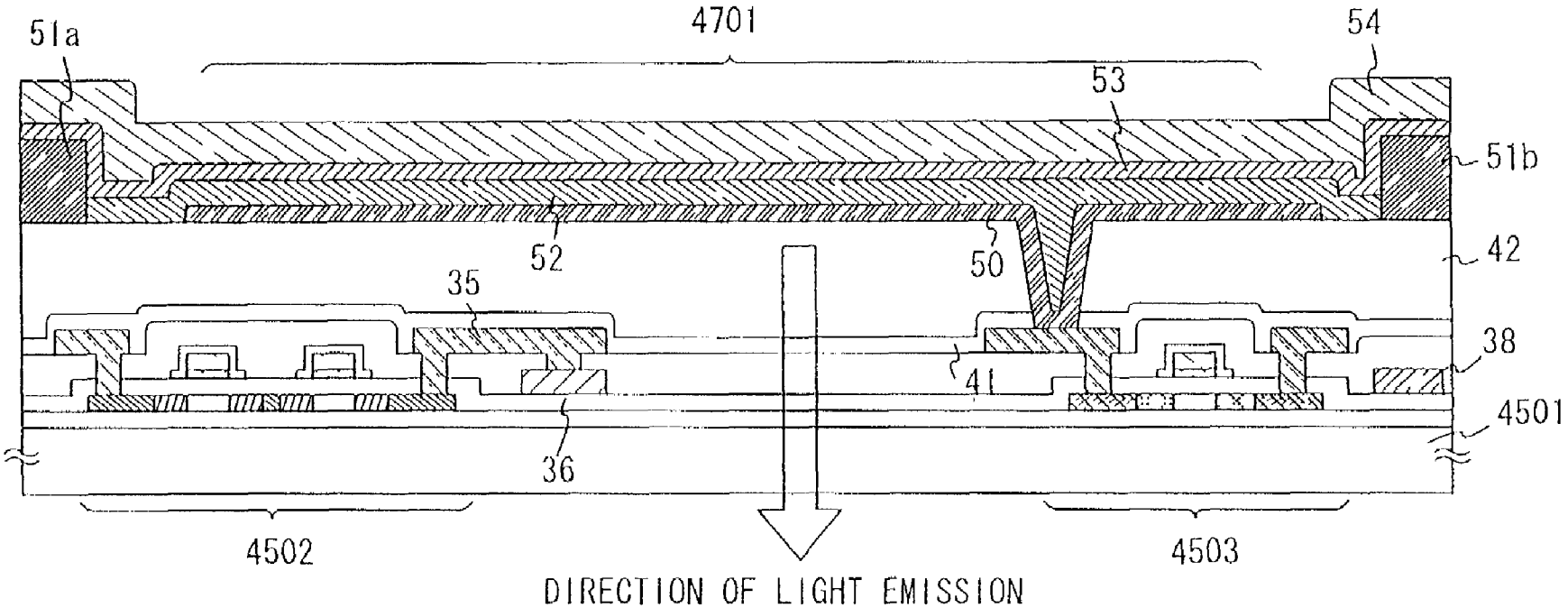
FIG. 20 is a view showing a fabrication example of an EL display device.

In this embodiment, a description will be made on a structure in which the structure of the EL element 4505 is inverted in the pixel portion shown in Embodiment 8. FIG. 20 is used for the description. Incidentally, points different from the structure of FIG. 18 are only a portion of an EL element and a current controlling TFT, the other explanation is omitted.

In FIG. 20, a current controlling TFT 4503 is formed by using a p-channel TFT formed by a known method.

In this embodiment, a transparent conductive film is used as a pixel electrode (anode) 50. Specifically, a conductive film made of a compound of indium oxide and zinc oxide is used. Of course, a conductive film made of a compound of indium oxide and tin oxide may be used.

After banks 51*a* and 51*b* made of insulating films are formed, a light emitting layer 52 made of polyvinylcarbazole is formed by solution application. An electron injecting layer 53 made of potassium acetylacetonate (expressed as acacK), and a cathode 54 made of aluminum alloy are formed thereon. In this case, the cathode 54 functions also as a passivation film. In this way, an EL element 4701 is formed.

In the case of this embodiment, light generated in the light emitting layer 52 is radiated to the substrate on which TFTs are formed as indicated by an arrow.

Embodiment 10

In this embodiment, an example of a case where a pixel is made to have a structure different from the circuit diagram shown in FIG. 19B will be described with reference to FIGS. 21A to 21C. In this embodiment, reference numeral 4801 designates a source wiring (signal line) of a switching TFT 4802; 4803 designates a gate wiring (scan line) of the switching TFT 4802; 4804 designates a current controlling TFT; 4805 designates a storage capacitor; 4806 and 4808 designate power supply lines; and 4807 designates an EL element.

Figure 21A:
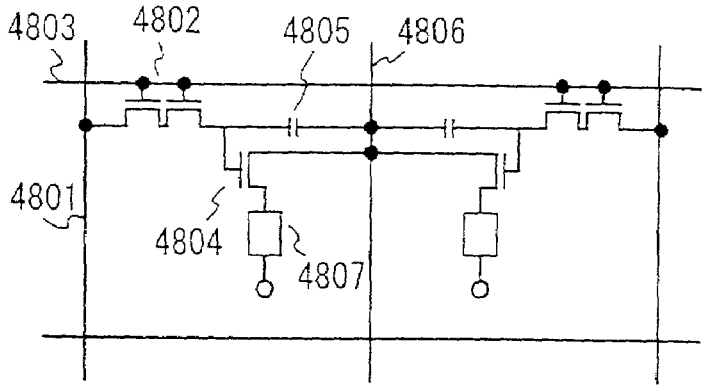
FIGS. 21A to 21C are views showing fabrication examples of EL display devices.

FIG. 21A shows an example in which the power supply line 4806 is made common between two pixels. That is, it is characterized in that the two pixels are formed to become axisymmetric with respect to the power supply line 4806. In this case, since the number of power supply lines can be decreased, the pixel portion can be made further fine.

Figure 21B:
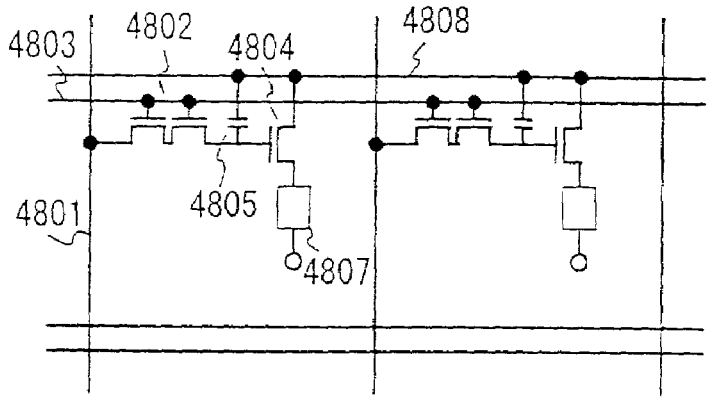

FIG. 21B shows an example in which the power supply line 4808 is provided in parallel with the gate wiring (scan line) 4803. Incidentally, although FIG. 21B shows the structure in which the power supply line 4808 does not overlap with the gate wiring (scan line) 4803, if both are wirings formed in different layers, they can be provided so that they overlap with each other through an insulating film. In this case, since an occupied area can be made common to the power supply 4808 and the gate wiring (scan line) 4803, the pixel portion can be further made fine.

Figure 21C:
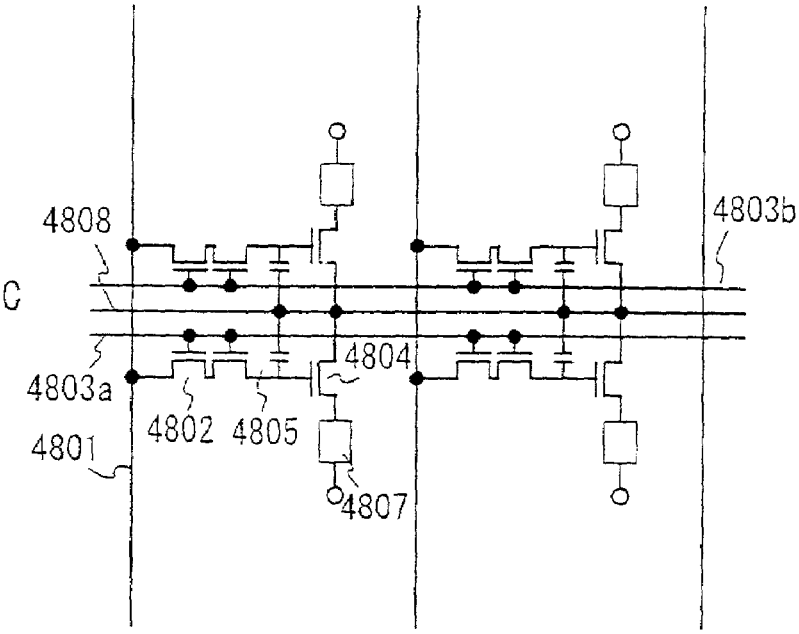

The structure of FIG. 21C is characterized in that the power supply line 4808 is provided in parallel with the gate wiring (scan line) 4803 similarly to the structure of FIG. 21B, and further, two pixels are formed so that they become axisymmetric with respect to the power supply line 4808. Besides, it is also effective to provide the power supply line 4808 in such a manner that it overlaps with either one of the gate wiring (scan line) 4803. In this case, since the number of power supply lines can be decreased, the pixel portion can be made further fine.

Embodiment 11

Although FIGS. 19A and 19B of Embodiment 8 show the structure in which the storage capacitor 4504 is provided to hold the voltage applied to the gate of the current controlling TFT 4503, the storage capacitor 4504 can also be omitted. In the case of Embodiment 8, the LDD region is provided at the drain side of the current controlling TFT 4503 so as to overlap with the gate electrode through the gate insulating film. Although a parasitic capacitance generally called a gate capacitance is formed in this overlapping region, this embodiment is characterized in that this parasitic capacitance is positively used instead of the storage capacitor 4504.

Since the capacity of this parasitic capacitance is changed by the overlapping area of the gate electrode and the LDD region, it is determined by the length of the LDD region contained in the overlapping region.

Also in the structures shown in FIGS. 21A, 21B and 21C of Embodiment 10, the storage capacitor 4805 can be similarly omitted.

Embodiment 12

In the present embodiment, a description will be given on an electronic equipment incorporating an image display device of the present invention. Following can be given as such an electronic equipment: portable information terminals (such as electronic books, mobile computers, and portable telephones); video cameras; steel cameras; personal computers; and TV. Examples of those are shown in FIGS. 22 to 24. Note that FIGS. 22, 23 and 24 show an active matrix liquid crystal display device of the image display devices and FIGS. 22 and 23 show an EL display device of the image display devices.

Figure 22A:
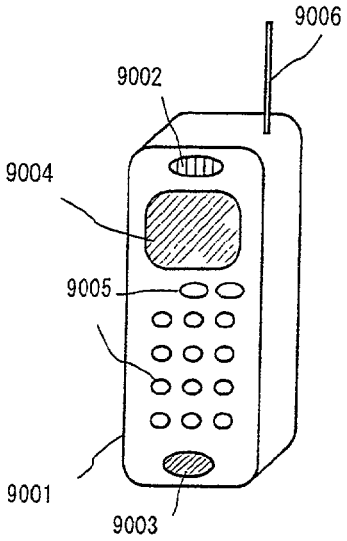
FIGS. 22A to 22F are views showing examples of electronic instruments using the present invention.

FIG. 22A is a portable telephone, and is composed of a main body 9001, a voice output portion 9002, a voice input portion 9003, a display portion 9004, operation switches 9005, and an antenna 9006. The present invention can be applied to the display portion 9004.

Figure 22B:
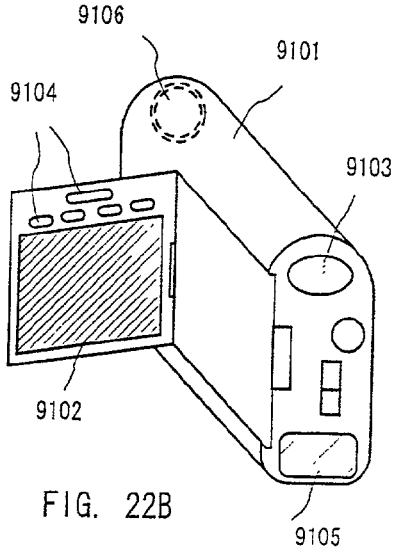

FIG. 22B is a video camera, and is composed of a main body 9101, a display portion 9102, a voice input section 9103, operation switches 9104, a battery 9105 and an image receiving section 9106. The present invention can be applied to the display portion 9102.

Figure 22C:
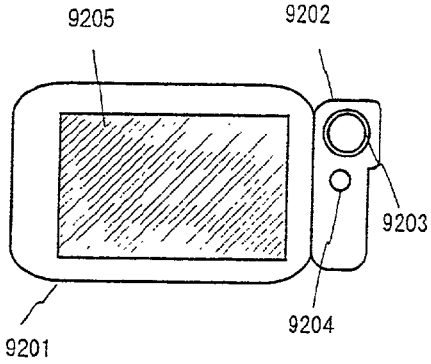

FIG. 22C is a mobile computer or a portable type information terminal which is one of personal computers, and is composed of a main body 9201, a camera portion 9202, an image receiving portion 9203, operation switches 9204, and a display portion 9205. The present invention can be applied to the display portion 9205.

Figure 22D:
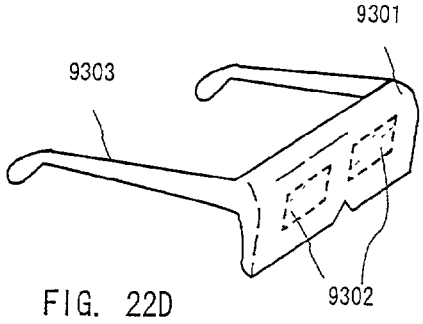

FIG. 22D is a head mount display (a goggle type display), and is composed of a main body 9301, a display portion 9302, and an arm portion 9303. The present invention can be applied to the display portion 9302.

Figure 22E:
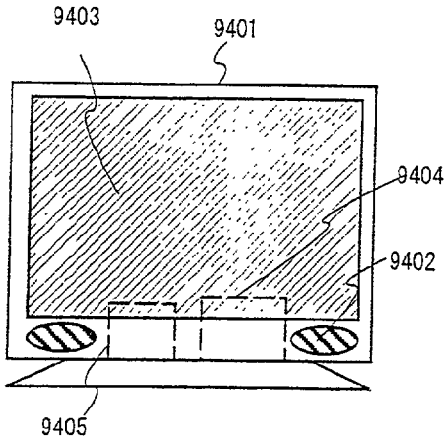

FIG. 22E is a television, and is composed of a main body 9401, speakers 9402, a display portion 9403, a receiving device 9404, and an amplification device 9405. The present invention can be applied to the display portion 9403.

Figure 22F:
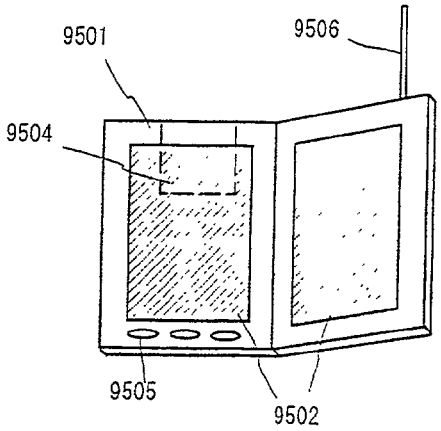

FIG. 22F is a portable electronic book, and is composed of a main body 9501, a display portion 9502, a memory medium 9504, an operation switch 9505 and an antenna 9506. The book is used to display data stored in a mini-disk (MD) or a CVD (Digital Versatile Disk), or a data received with the antenna. The present invention can be applied to the display portion 9502.

Figure 23A:
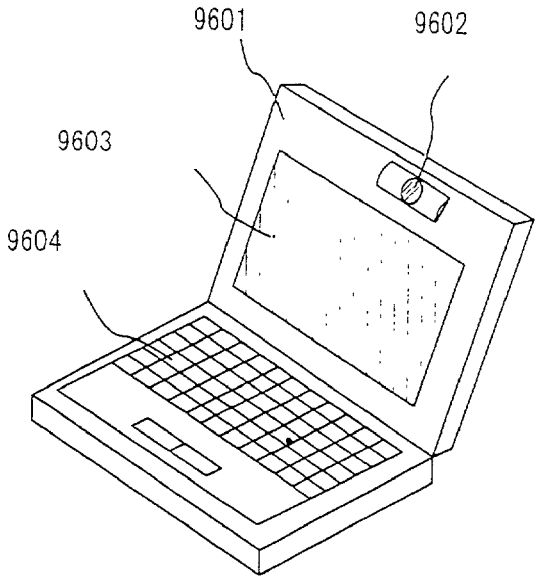
FIGS. 23A to 23D are views showing examples of electronic instruments using the present invention.

FIG. 23A is a personal computer, and is composed of a main body 9601, an image inputting portion 9602, a display portion 9603 and a keyboard 9604. The present invention can be applied to the display portion 9603.

Figure 23B:
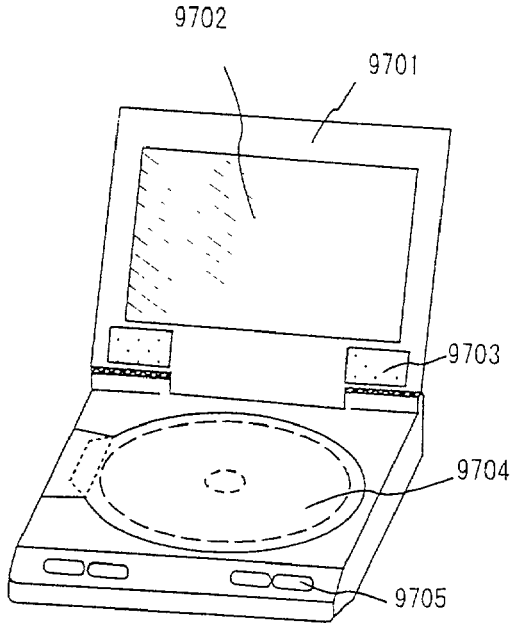

FIG. 23B is a player that employs a recording medium in which programs are recorded (hereinafter, called as a recording medium), and is composed of a main body 9701, a display portion 9702, a speaker portion 9703, a recording medium 9704, and an operation switch 9705. Note that this player uses a CVD (Digital Versatile Disc). CD and the like as the recording medium to appreciate music and films, play games. and connect to the Internet. The present invention can be applied to the display portion 9702.

Figure 23C:
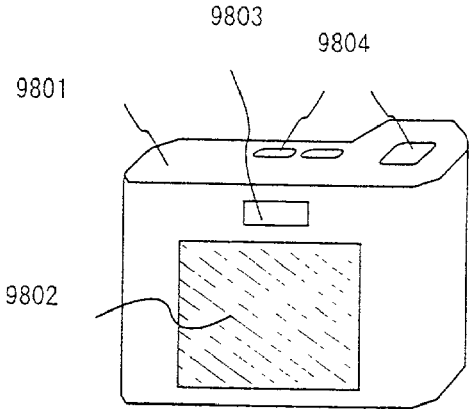

FIG. 23C is a digital camera comprising a main body 9801, a display portion 9802, an eye piece 9803, operation switches 9804, and an image receiving portion (not shown). The present invention can be applied to the display portion 9802.

Figure 23D:
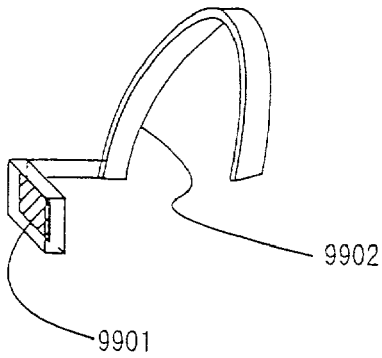

FIG. 23D is a one-eyed head mount display comprising a display portion 9901, and a head mount portion 9902. The present invention can be applied to the display portion 9901.

Figure 24A:
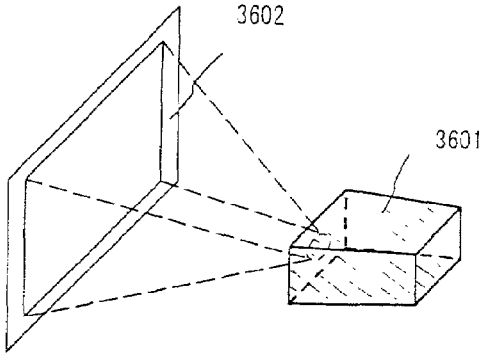
FIGS. 24A to 24D are views showing structures of projection type liquid crystal display devices.

FIG. 24A is a front-type projector comprising a projection device 3601, and a screen 3602.

Figure 24B:
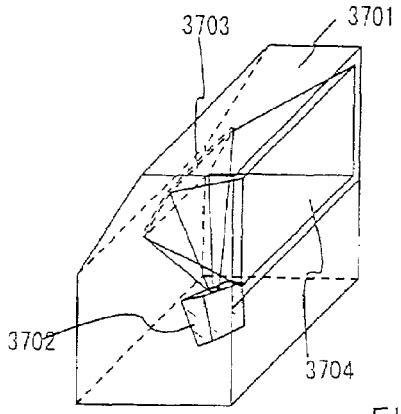

FIG. 24B is a rear-type projector comprising a main body 3701, a projection device 3702, a mirror 3703, and a screen 3704.

Figure 24C:
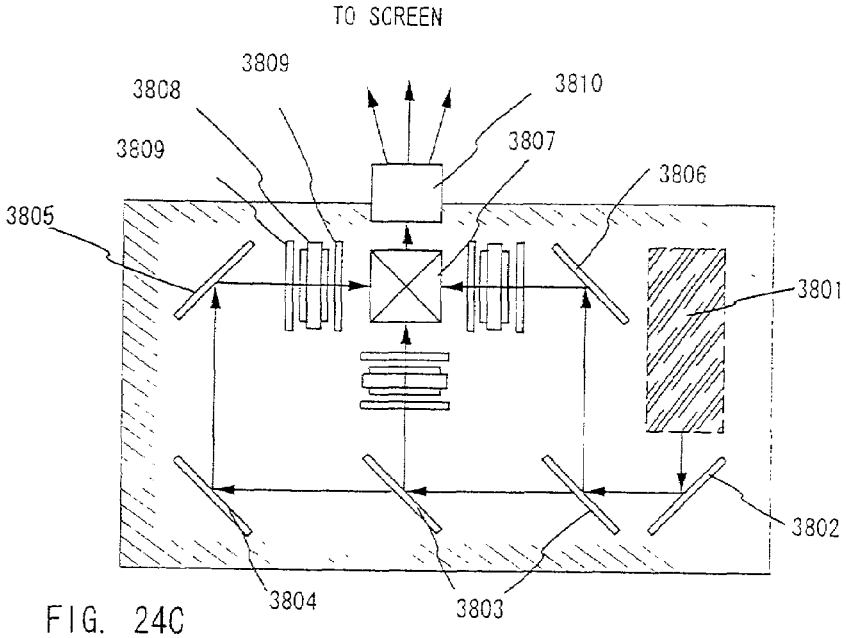

Note that FIG. 24C is a diagram showing an example of the structure of the projection devices 3601 and 3702 in FIGS. 24A and 24B. The projection devices 3601 and 3702 comprise a light source optical system 3801, mirrors 3802, 3804 to 3806, a dichroic mirror 3803, a prism 3807, a liquid crystal display portion 3808, a phase difference plate 3809, and a projection optical system 3810. The projection optical system 3810 is composed of an optical system including a projection lens. While this embodiment shows an example of a three plate type projection device, a single plate type projection device can also be used. Further, in the light path indicated by an arrow in FIG. 24C, an optical system such as an optical lens, a film having a polarization function, a film for adjusting a phase difference, and an IR film may be suitably provided by an operator who carries out the invention. The present invention can be applied to the liquid crystal display portion 3808.

Figure 24D:
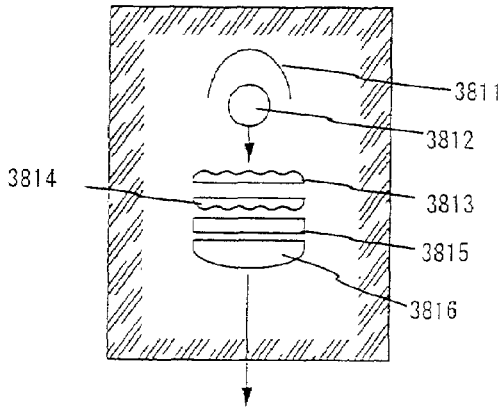
Figure 25:
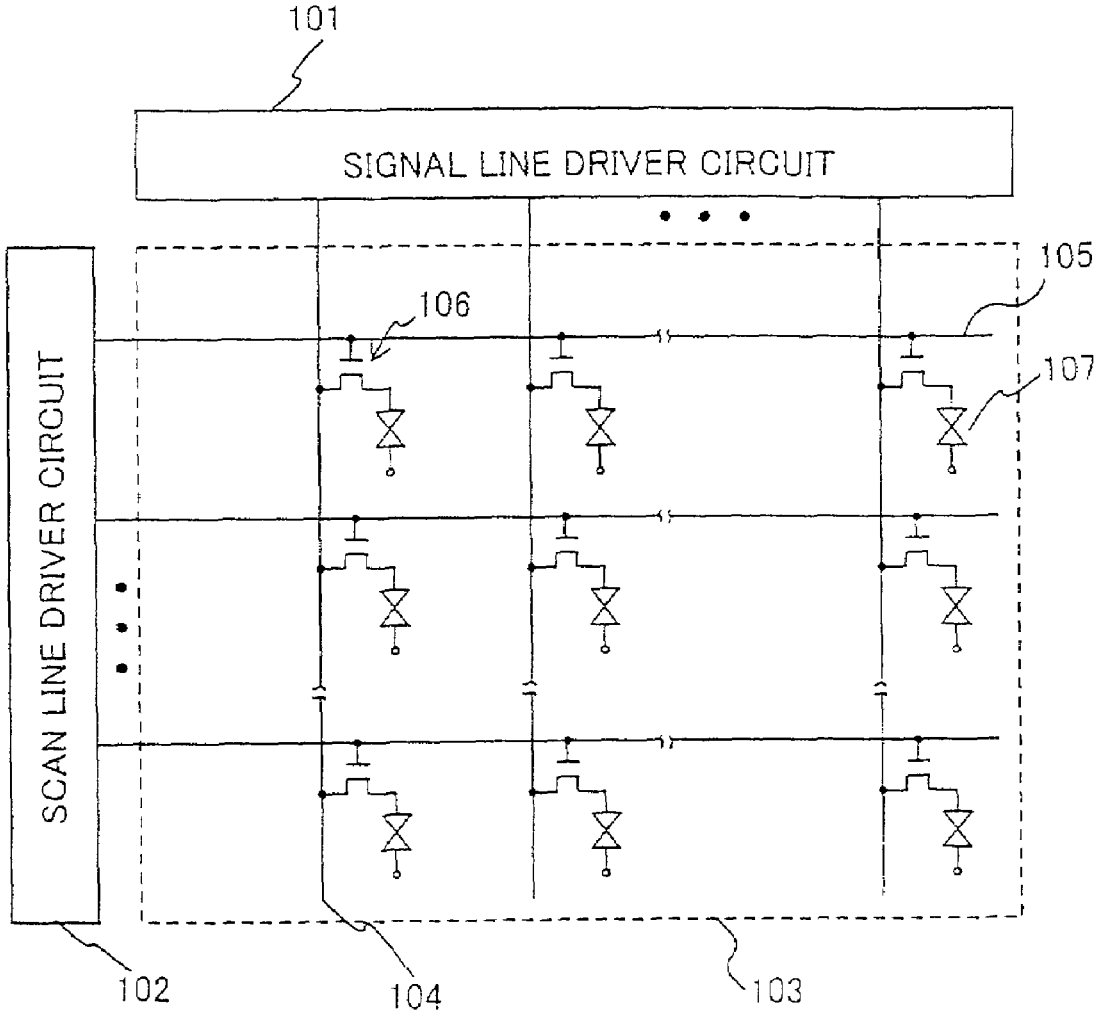
FIG. 25 is a structural view of an active matrix type liquid crystal display device.
Figure 26:
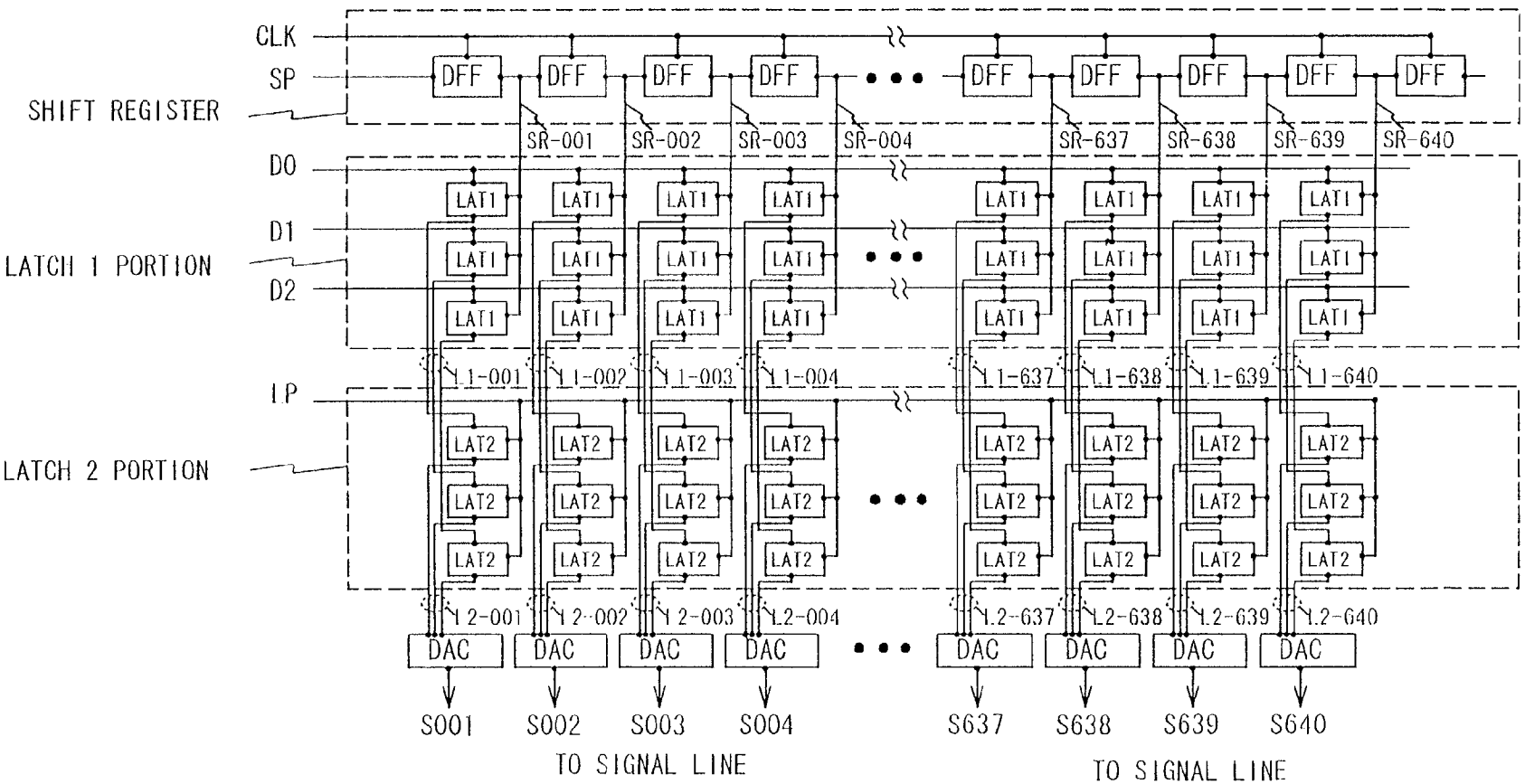
FIG. 26 is a structural view of a conventional digital system signal line driver circuit.
Figure 27:
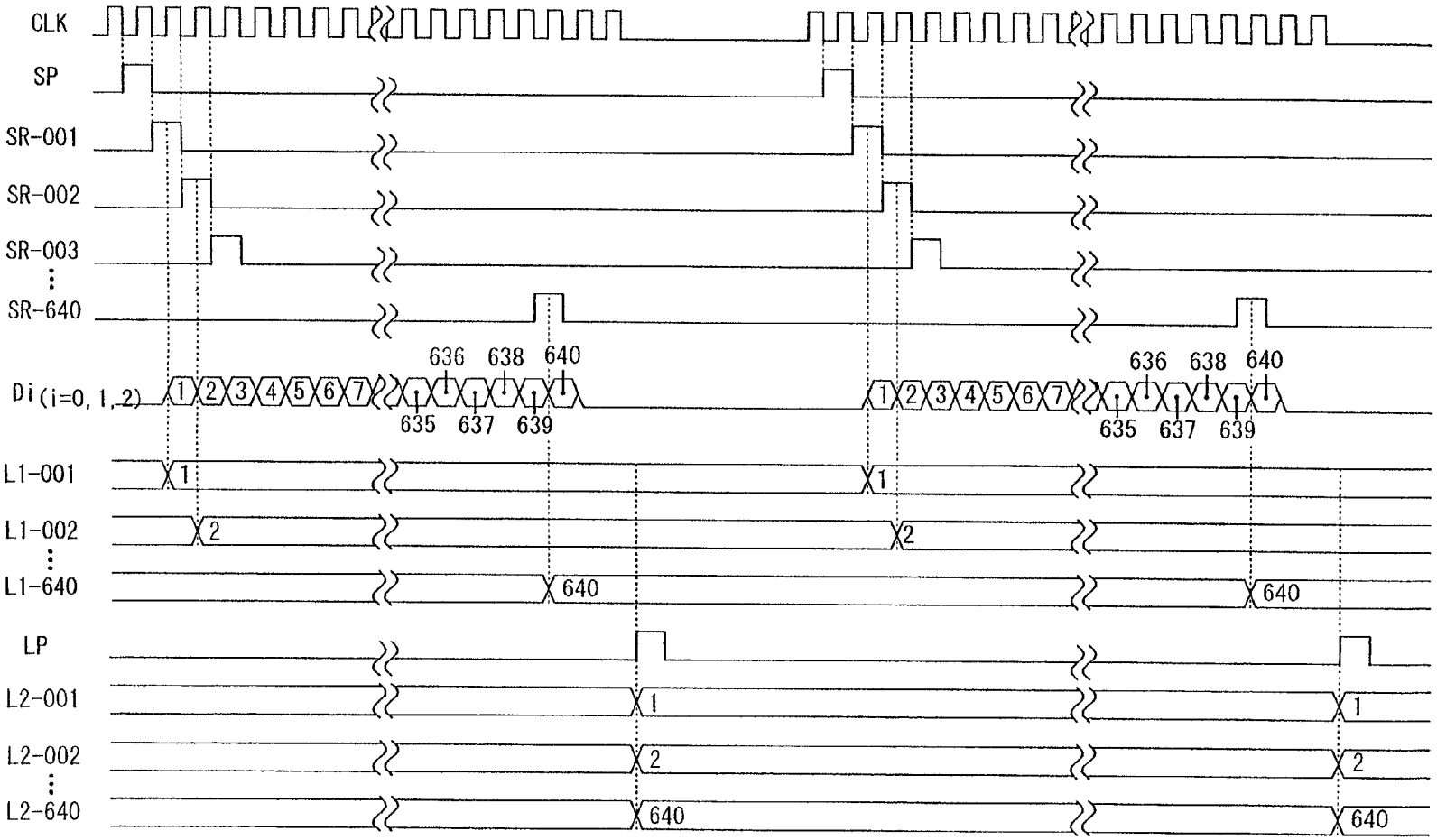
FIG. 27 is a view showing timing chart of the conventional digital system signal line driver circuit.

Further, FIG. 24D is a diagram showing an example of the structure of the light source optical system 3801 in FIG. 24C. In this embodiment, the light source optical system

3801 comprises a reflector 3811, a light source 3812, lens arrays 3813 and 3814, a polarization conversion element 3815, and a condenser lens 3816. Note that the light source optical system shown in FIG. 24D is merely an example, and is not particularly limited thereto. For example, an operator who carries out the invention is allowed to suitably add an optical system such as an optical lens, a film having a polarization function, a film for adjusting a phase difference, and an IR film to the light source optical system.

The applicable range of the present invention is thus extremely wide, and it is possible to apply the present invention to electronic equipments using an image display device in all fields.

The driver circuit of the image display device according to the present invention can greatly reduce the area of the signal line driver circuit, is effective for miniaturization of the image display device, reduces the resistance and capacitance parasitic to the wiring of the digital picture signal, and increases the operation margin of the driver circuit. These are effective in the cost reduction of the image display device and the improvement of the yield thereof.

What is claimed is:

1. An image display device, comprising:

a pixel array portion including a plurality of signal lines, a plurality of scan lines, a plurality of pixel electrodes provided at respective regions where the respective signal lines and the respective scan lines intersect with each other, and a plurality of switching elements for driving the plurality of pixel electrodes;

a signal line driver circuit for driving the plurality of signal lines; and a scan line driver circuit for driving the plurality of scan lines, wherein the signal line driver circuit includes an integral multiple of m shift registers to which m-bit (m is a natural number) digital picture signals are inputted, a plurality of storage circuits for storing output signals of the shift registers, a plurality of D/A converter circuits for converting output signals of the plurality of storage circuits into analog signals, and a plurality of signal line selecting circuits for transmitting output signals of the plurality of D/A converter circuits to the corresponding signal lines, wherein an operation, in which the digital picture signals are inputted to the respective shift registers, the inputted digital picture signals are sequentially shifted in the respective shift registers in synchronization with a clock signal until they are outputted to the corresponding storage circuits, and the shifted digital picture signals are taken into the storage circuits by a latch signal while a supply of the clock signal to the respective shift registers is being stopped, is repeated n (n is an integer not less than 2) times in a time corresponding to one horizontal scan period, and wherein the plurality of signal line selecting circuits start and stop transmitting the output signals of the plurality of D/A converter circuits while the supply of the clock signal is being stopped.

2. A device according to claim 1, wherein each of the plurality of D/A converter circuits comprises a bit comparison pulse width converter circuit and an analog switch.

3. A device according to claim 1, wherein each of the plurality of storage circuits is a latch circuit.

4. A device according to claim 3, wherein the latch circuit includes an analog switch and a holding capacitance.

5. A device according td claim 3, wherein the latch circuit includes a clocked inverter.

6. A device according to claim 3, wherein the latch circuit includes an analog switch and a plurality of inverters.

7. A device according to claim 1, wherein a display is carried out using a liquid crystal material.

8. A device according to claim 1, wherein a display is carried out using an electroluminescence (EL) material.

9. A device according to claim 1, wherein the device is used in an electronic equipment selected from the group consisting of a portable telephone, a video camera, a personal computer, a head mount display, a television, a portable book, a CVD player, a digital camera and a projector.

10. A signal line driver circuit of an image display device for driving a plurality of signal lines, the signal line driver circuit comprising:

an integral multiple of m shift registers to which m-bit (m is a natural number) digital picture signals are inputted;

a plurality of storage circuits for storing output signals of the shift registers;

a plurality of D/A converter circuits for converting output signals of the plurality of storage circuits into analog signals; and a plurality of signal line selecting circuits for transmitting output signals of the plurality of D/A converter circuits to the corresponding signal lines, wherein an operation, in which the digital picture signals are inputted to the respective shift registers, the inputted digital picture signals are sequentially shifted in the respective shift registers in synchronization with a clock signal until they are outputted to the corresponding storage circuits, and the shifted digital picture signals are taken into the storage circuits by a latch signal while a supply of the clock signal to the respective shift registers is being stopped, is repeated n (n is an integer not less than 2) times in a time corresponding to one horizontal scan period, and wherein the plurality of signal line selecting circuits start and stop transmitting the output signals of the plurality of D/A converter circuits while the supply of the clock signal is being stopped.

11. A circuit according to claim 10, wherein each of the plurality of D/A converter circuits comprises a bit comparison pulse width converter circuit and an analog switch.

12. A circuit according to claim 10, wherein each of the plurality of storage circuits is a latch circuit.

13. A circuit according to claim 12, wherein the latch circuit includes an analog switch and a holding capacitance.

14. A circuit according to claim 12, wherein the latch circuit includes a clocked inverter.

15. A circuit according to claim 12, wherein the latch circuit includes an analog switch and a plurality of inverters.

16. A circuit according to claim 10, wherein the driver circuit of the image display device is formed of a polysilicon thin film transistor.

17. A circuit according to claim 10, wherein the driver circuit of the image display device is formed of a single crystal transistor.

18. An image display device, comprising:

a pixel array portion including k (k is an integer not less than 2) signal lines, a plurality of scan lines, a plurality of pixel electrodes provided at respective regions where the respective signal lines and the respective scan lines intersect with each other, and a plurality of switching elements for driving the plurality of pixel electrodes;

a signal line driver circuit for driving the k signal lines; and a scan line driver circuit for driving the plurality of scan lines, wherein the signal line driver circuit includes shift registers to which m-bit (m is a natural number) digital picture signals are inputted, the number of the shift registers being an integral multiple of m, m×k/n (n is an integer of not less than 2) storage circuits for storing output signals of the shift registers, a plurality of D/A converter circuits for converting output signals of the plurality of storage circuits into analog signals, and k/n signal line selecting circuits for transmitting output signals of the plurality of D/A converter circuits to the corresponding signal lines, wherein an operation, in which the digital picture signals are inputted to the respective shift registers, the inputted digital picture signals are sequentially shifted in the respective shift registers in synchronization with a clock signal until they are outputted to the corresponding storage circuits, and the shifted digital picture signals are taken into the storage circuits by a latch signal while a supply of the clock signal to the respective shift registers is being stopped, is repeated j (j is an integer not less than 2) times in a time corresponding to one horizontal scan period, and wherein the plurality of signal line selecting circuits start and stop transmitting the output signals of the plurality of D/A converter circuits while the supply of the clock signal is being stopped.

19. A device according to claim 18, wherein the number of the plurality of D/A converter circuits is k/n.

20. A device according to claim 18, wherein each of the plurality of D/A converter circuits comprises a bit comparison pulse width converter circuit and an analog switch.

21. A device according to claim 18, wherein each of the plurality of storage circuits is a latch circuit.

22. A device according to claim 21, wherein the latch circuit includes an analog switch and a holding capacitance.

23. A device according to claim 21, wherein the latch circuit includes a clocked inverter.

24. A device according to claim 21, wherein the latch circuit includes an analog switch and a plurality of inverters.

25. A device according to claim 18, wherein a display is carried out using a liquid crystal material.

26. A device according to claim 18, wherein a display is carried out using an electroluminescence (EL) material.

27. A device according to claim 18, wherein the device is used in an electronic equipment selected from the group consisting of a portable telephone, a video camera, a personal computer, a head mount display, a television, a portable book, a CVD player, a digital camera and a projector.

28. A signal line driver circuit of an image display device for driving k (k is an integer not less than 2) signal lines, the signal line driver circuit comprising:

shift registers to which m-bit (m is a natural number) digital picture signals are inputted, the number of the shift registers being an integral multiple of m;

m×k/n (n is an integer of not less than 2) storage circuits for storing output signals of the shift registers;

a plurality of D/A converter circuits for converting output signals of the plurality of storage circuits into analog signals; and k/n signal line selecting circuits for transmitting output signals of the plurality of D/A converter circuits to the corresponding signal lines, wherein an operation, in which the digital picture signals are inputted to the respective shift registers, the inputted digital picture signals are sequentially shifted in the respective shift registers in synchronization with a clock signal until they are outputted to the corresponding storage circuits, and the shifted digital picture signals are taken into the storage circuits by a latch signal while a supply of the clock signal to the respective shift registers is being stopped, is repeated j (j is an integer not less than 2) times in a time corresponding to one horizontal scan period, and wherein the k/n signal line selecting circuits start and stop transmitting the output signals of the plurality of D/A converter circuits while the supply of the clock signal is being stopped.

29. A circuit according to claim 28, wherein the number of the plurality of D/A converter circuits is k/n.

30. A circuit according to claim 28, wherein each of the plurality of D/A converter circuits comprises a bit comparison pulse width converter circuit and an analog switch.

31. A circuit according to claim 28, wherein each of the plurality of storage circuits is a latch circuit.

32. A circuit according to claim 31, wherein the latch circuit includes an analog switch and a holding capacitance.

33. A circuit according to claim 31, wherein the latch circuit includes a clocked inverter.

34. A circuit according to claim 31, wherein the latch circuit includes an analog switch and a plurality of inverters.

35. A circuit according to claim 28, wherein the driver circuit of the image display device is formed of a polysilicon thin film transistor.

36. A circuit according to claim 28, wherein the driver circuit of the image display device is formed of a single crystal transistor.

* * * * *